US011448991B2

(12) United States Patent
Mukaihara et al.

(10) Patent No.: US 11,448,991 B2
(45) Date of Patent: Sep. 20, 2022

(54) IMAGE FORMING APPARATUS THAT OBTAINS COLOR MISREGISTRATION AMOUNT USING DETECTION RESULT OF TEST IMAGE

(71) Applicant: CANON KABUSHIKI KAISHA, Tokyo (JP)

(72) Inventors: Takuya Mukaihara, Shizuoka (JP); Kazutaka Yaguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/189,630

(22) Filed: Mar. 2, 2021

(65) Prior Publication Data

US 2021/0278792 A1 Sep. 9, 2021

(30) Foreign Application Priority Data

Mar. 4, 2020 (JP) ..... JP2020-037157

(51) Int. Cl.
*G03G 15/01* (2006.01)
*G03G 15/00* (2006.01)

(52) U.S. Cl.
CPC ..... *G03G 15/55* (2013.01); *G03G 15/01* (2013.01); *G03G 15/5062* (2013.01); *G03G 2215/00042* (2013.01); *G03G 2215/0161* (2013.01)

(58) Field of Classification Search
CPC ..... G03G 15/01; G03G 15/5058; G03G 15/5062; G03G 15/55; G03G 2215/00042; G03G 2215/0158; G03G 2215/0161
See application file for complete search history.

(56) References Cited

U.S. PATENT DOCUMENTS

| | | | | |
|---|---|---|---|---|
| 5,287,162 | A | 2/1994 | de Jong et al. | |
| 6,292,208 | B1 * | 9/2001 | Lofhus | H04N 1/047 347/234 |
| 7,658,462 | B2 * | 2/2010 | Eom | G03G 15/0194 347/19 |
| 2006/0188298 | A1 * | 8/2006 | Aikawa | G03G 15/0194 399/301 |

FOREIGN PATENT DOCUMENTS

| | | | |
|---|---|---|---|
| JP | 06-118735 | A | 4/1994 |
| JP | 11-164161 | A | 6/1999 |
| JP | 2001-134034 | A | 5/2001 |

* cited by examiner

*Primary Examiner* — Sophia S Chen
(74) *Attorney, Agent, or Firm* — Venable LLP

(57) ABSTRACT

An image forming apparatus includes a detecting unit configured to detect a test image formed on an image carrier; and an obtaining unit configured to obtain a color misregistration amount using a detection result of the test image by the detecting unit. The test image includes one or more basic patterns; each one of the one or more basic patterns includes a first pattern group and a second pattern group disposed at different positions with respect to a conveyance direction of the image carrier; the first pattern group and the second pattern group each include a plurality of V-shaped patterns; and the V-shaped patterns of the first pattern group and the second pattern group have an axisymmetrical shape about an axis corresponding to a width direction orthogonal to the conveyance direction.

21 Claims, 12 Drawing Sheets

IMAGE FORMING APPARATUS THAT OBTAINS COLOR MISREGISTRATION AMOUNT USING DETECTION RESULT OF TEST IMAGE

BACKGROUND OF THE INVENTION

Field of the Invention

The present invention relates to a technique for determining the color misregistration amount of an image forming apparatus, such as a color laser printer and a color copy machine.

Description of the Related Art

In an image forming apparatus, the color misregistration amount is determined by forming a color misregistration amount test image on an intermediate transfer belt, for example, and detecting the reflected light from the test image with an optical sensor.

The configuration described in U.S. Pat. No. 5,287,162 determines the color misregistration amount using a test image that includes a plurality of chevron marks pointing in the same direction. The configuration described in Japanese Patent Laid-Open No. 2001-134034 determines the color misregistration amount by forming a plurality of test images including a plurality of chevron marks pointing in the same direction in at least one revolution of an intermediate transfer belt. Also, in Japanese Patent Laid-Open No. 11-164161, a method for initial adjustment of an image forming position by an image forming apparatus is described. According to Japanese Patent Laid-Open No. 11-164161, by storing correction data for executing initial adjustment in the image forming apparatus in advance, the adjustment process of the image forming position typically executed prior to being factory-shipped is not required.

In the configuration described in U.S. Pat. No. 5,287,162 and the configuration described in Japanese Patent Laid-Open No. 2001-134034, the determination accuracy of the color misregistration amount is degraded in cases of color misregistration that cause the image to be inclined or cause the length in the main scan direction to be smaller or longer. In particular, when the adjustment process of the image forming position is omitted or simplified as described in Japanese Patent Laid-Open No. 11-164161, the color misregistration amount of the image increases. When this occurs, with the configuration of U.S. Pat. No. 5,287,162 and the configuration of Japanese Patent Laid-Open No. 2001-134034, the error in the determined color misregistration amount becomes an amount unable to be ignored.

SUMMARY OF THE INVENTION

According to an aspect of the present invention, an image forming apparatus includes: an image forming unit configured to form an image on a rotationally driven image carrier using toner of a plurality of colors including a first color and a second color; a detecting unit configured to detect a test image formed on the image carrier by the image forming unit; and an obtaining unit configured to obtain a color misregistration amount using a detection result of the test image by the detecting unit, wherein the test image includes one or more basic patterns; each one of the one or more basic patterns includes a first pattern group and a second pattern group disposed at different positions in a conveyance direction of the image carrier; the first pattern group and the second pattern group each include a plurality of V-shaped patterns; and the V-shaped patterns of the first pattern group and the second pattern group have an axisymmetrical shape about an axis corresponding to a width direction orthogonal to the conveyance direction.

Further features of the present invention will become apparent from the following description of exemplary embodiments with reference to the attached drawings.

DESCRIPTION OF THE EMBODIMENTS

Figure 1A:
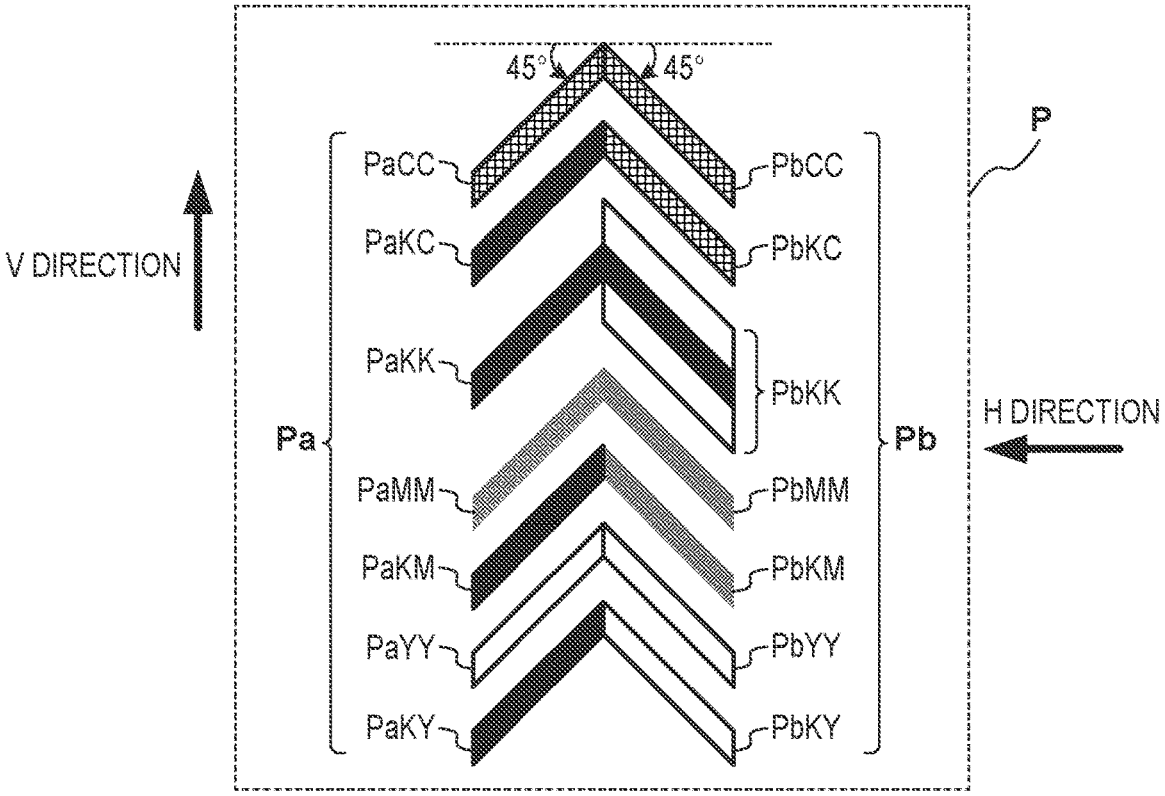
FIGS. 1A and 1B are diagrams illustrating basic patterns according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

Figure 12:
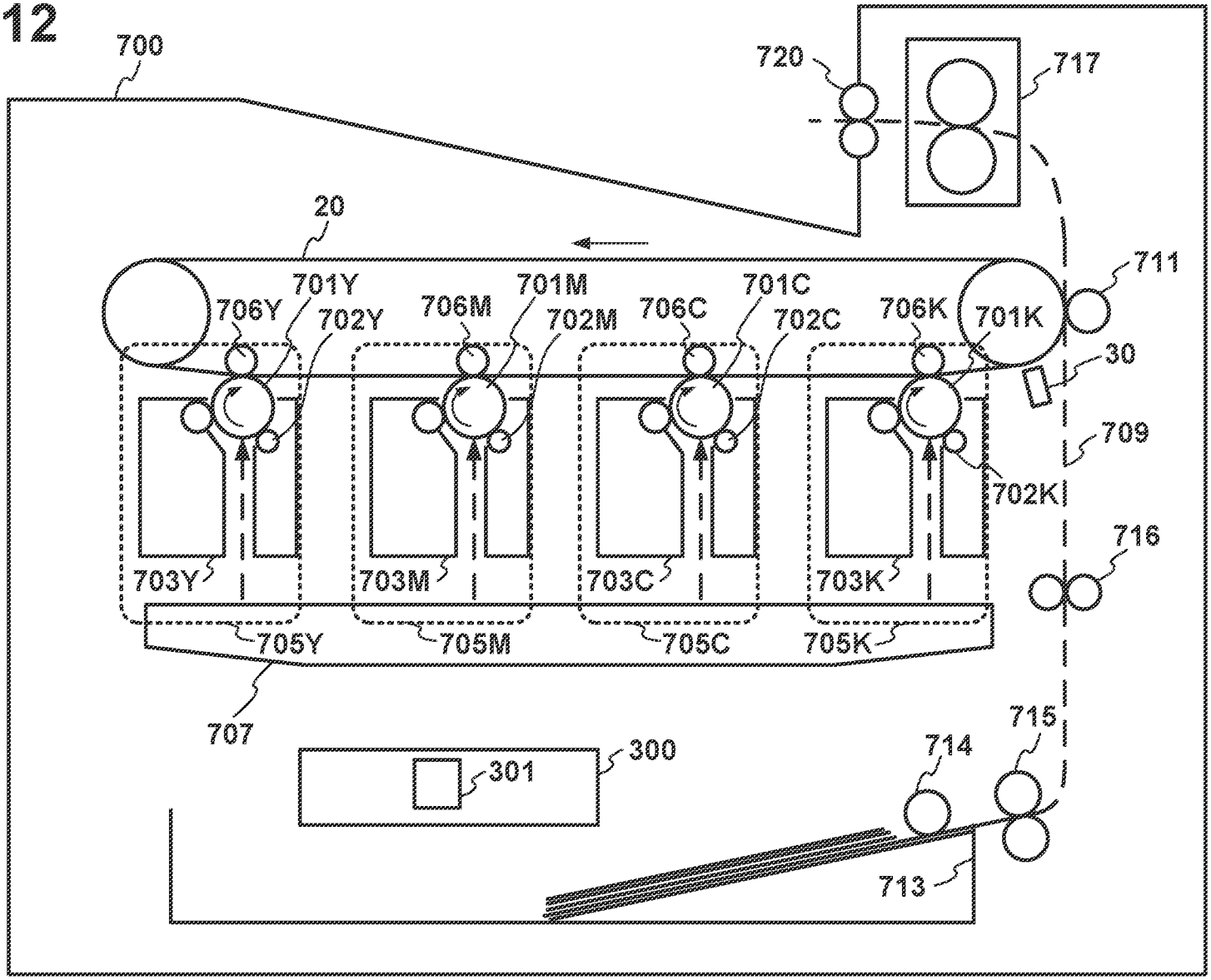
FIG. 12 is a configuration diagram of an image forming apparatus according to an embodiment.

FIG. 12 is a configuration diagram of an image forming apparatus 700 of the present embodiment. Note that the letters Y, M, C, and K affixed to the end of the reference signs indicate the color, respectively, yellow, magenta, cyan, and black, of the toner image that the member is involved in forming. When the color is not required to be distinguished in the following description, the letters Y, M, C and K are not affixed to the end of the reference sign. An image forming unit 705 includes for each color a photosensitive member (transfer member) 701, a charging unit 702, a developing unit 703, and a primary transfer roller 706. Also, the image forming apparatus 700 includes a single exposure unit 707. The image forming units 705 and the exposure unit 707 form a toner image of the photosensitive members 701 via a known electrophotographic process. The primary transfer roller 706 transfers a toner image of the corresponding photosensitive member 701 to an intermediate transfer belt 20. The intermediate transfer belt 20 is an image carrier and is rotationally driven in the anticlockwise (counterclockwise) direction of FIG. 12 when forming an image. A full color toner image can be formed on the intermediate transfer belt 20 by transferring the toner images of each color in an overlapping manner on the intermediate transfer belt 20.

1 The recording material in a cassette 713 is conveyed along a conveyance path 709 by conveyance rollers 714, 715, and 716 to a position opposite a secondary transfer roller 711. The secondary transfer roller 711 transfers the toner image of the intermediate transfer belt 20 to the recording material. The recording material with the transferred toner image is heated and pressed at a fixing unit 717 to fix the toner image to the recording material. Thereafter, the recording material is discharged outside the apparatus by a conveyance roller 720. A control unit 300 is provided with a microcomputer 301 and controls the entire image forming apparatus 700. Also, an optical sensor 30 is provided at a position opposite the intermediate transfer belt 20. The optical sensor 30 detects various types of test images for testing color misregistration amount, density, and the like and outputs the detection result to the microcomputer 301. The microcomputer 301 controls the correction of color misregistration, density, and the like on the basis of the detection result of the test images. Note that hereinafter, the direction in which the front surface of the intermediate transfer belt 20 moves is referred to as the sub-scan direction or conveyance direction, and the direction orthogonal to the sub-scan direction is referred to as the main scan direction or width direction.

Figure 11A:
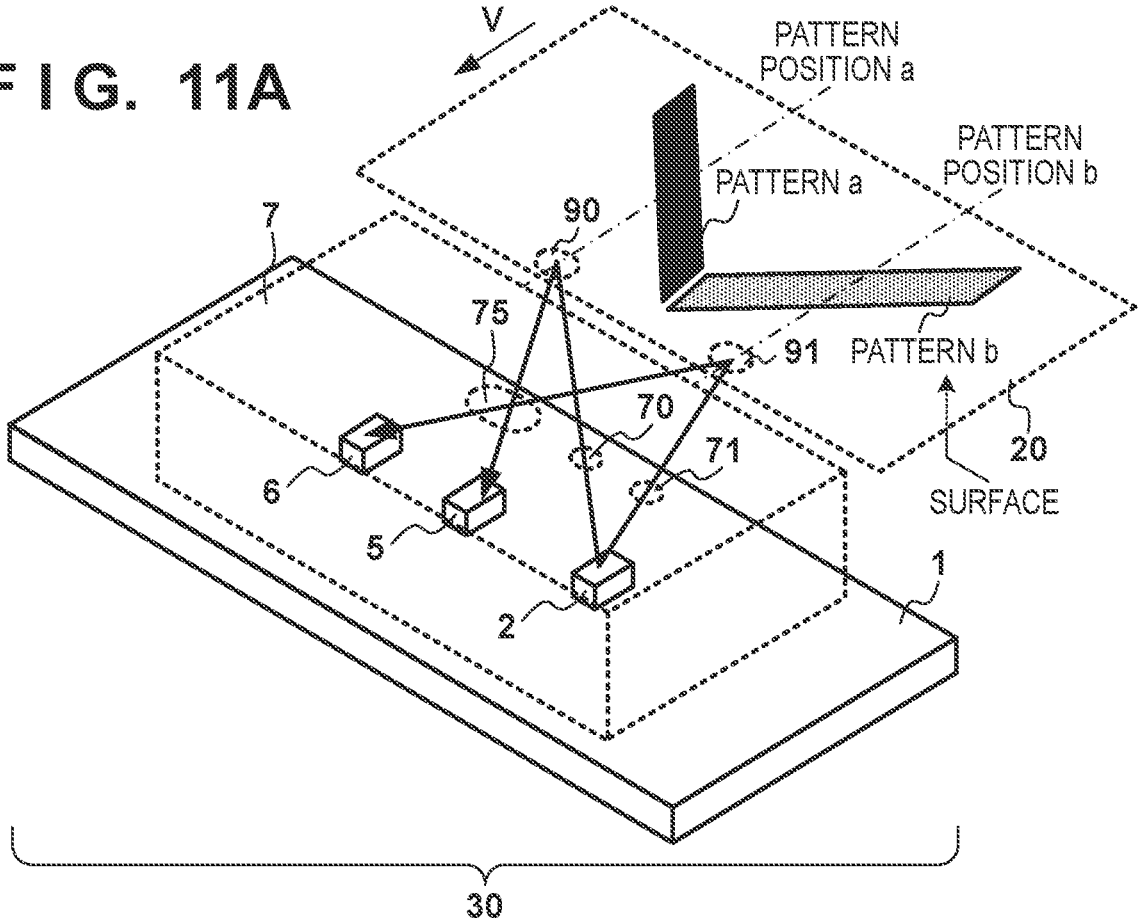
FIGS. 11A and 11B are configuration diagrams of an optical sensor according to an embodiment.
Figure 11B:
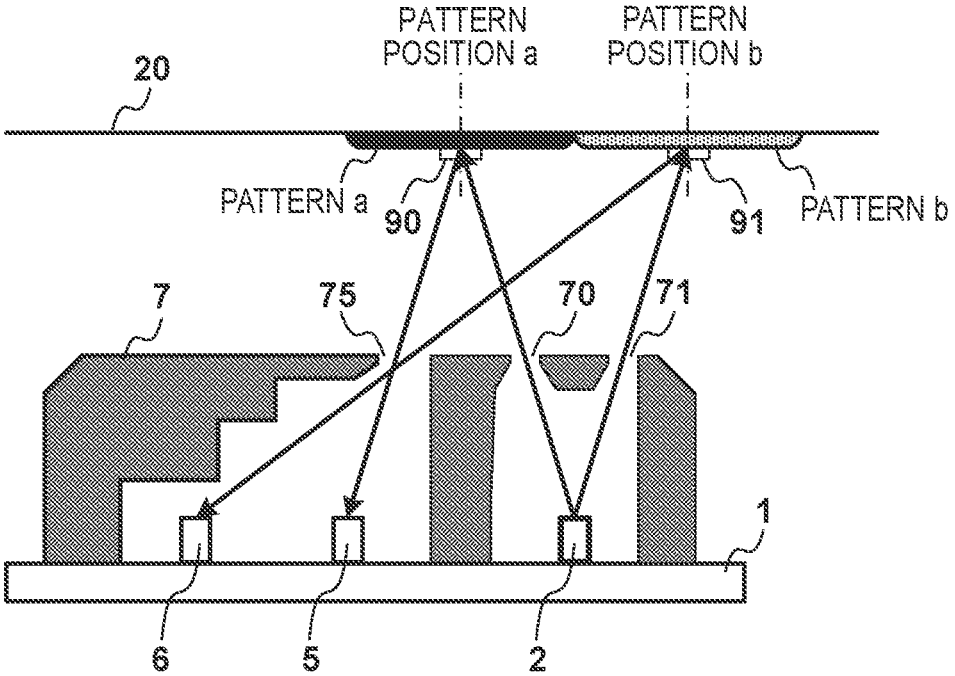

FIGS. 11A and 11B are configuration diagrams of the optical sensor 30. Note that FIG. 11A is a perspective view of the optical sensor 30, and FIG. 11B is a cross-sectional view thereof. The optical sensor 30 includes an LED (light-emitting unit) 2 and light-receiving elements (light-receiving units) 5 and 6 provided on a printed circuit board 1. Also, the optical sensor 30 includes a diaphragm member 7 provided with openings 70, 71, and 75 for adjusting and regulating the optical path. The light emitted from the LED 2 that passes through the opening 71 irradiates a region 91 of the intermediate transfer belt 20. The light-receiving element 6 is provided in a manner to mainly receive the diffuse reflected light that undergoes diffuse reflection at the region 91 and passes through the opening 75. The light emitted from the LED 2 that passes through the opening 70 irradiates a region 90 of the intermediate transfer belt 20. The light-receiving element 5 is provided in a manner to mainly receive the specular reflected light that undergoes specular reflection at the region 90 and passes through the opening 75. As illustrated in FIG. 11A, the main scan direction position corresponding to the region 90 (reflection position) of the intermediate transfer belt 20 is referred to as pattern position a, and the main scan direction position corresponding to the region 91 (reflection position) is referred to as pattern position b. Note that as described below, the color misregistration amount test image is formed across the pattern position a and the pattern position b. The light-receiving elements 5 and 6 output a signal corresponding to the amount of received light to the microcomputer 301.

FIG. 12 is a configuration diagram of an image forming apparatus 700 of the present embodiment. Note that the letters Y, M, C, and K affixed to the end of the reference signs indicate the color, respectively, yellow, magenta, cyan, and black, of the toner image that the member is involved in forming. When the color is not required to be distinguished in the following description, the letters Y, M, C and K are not affixed to the end of the reference sign. An image forming unit 705 includes for each color a photosensitive member (transfer member) 701, a charging unit 702, a developing unit 703, and a primary transfer roller 706. Also, the image forming apparatus 700 includes a single exposure unit 707. The image forming units 705 and the exposure unit 707 form a toner image of the photosensitive members 701 via a known electrophotographic process. The primary transfer roller 706 transfer a toner image of the corresponding photosensitive member 701 to an intermediate transfer belt 20. The intermediate transfer belt 20 is an image carrier and is rotationally driven in the anticlockwise direction of FIG. 12 when forming an image. A full color toner image can be formed on the intermediate transfer belt 20 by transferring the toner images of The optical sensor 30 of the present embodiment may be used in both density correction control and color misregistration correction control. In density correction control, a test image (density test image) for testing the density of the colors is formed on the intermediate transfer belt 20 and the intensity of the light reflected from the formed test image is detected by the optical sensor 30. The amount of specular reflected light from the test image is used to detect the density. As described above, the light-receiving element 5 of the optical sensor 30 is provided at a position where specular reflected light reflected at the region 90 is received. However, diffuse reflected light from the intermediate transfer belt 20 (or the test image formed thereon) may also be incident on the light-receiving element 5. In other words, the amount of light received by the light-receiving element 5 may include a component of diffuse reflected light. By executing correction processing to reduce the diffuse reflected light component included in the amount of light received by the light-receiving element 5 on the basis of the amount of diffuse reflected light received by the light-receiving element 6, the density of the test image can be accurately detected. The color misregistration correction control will be described below.

Figure 1B:
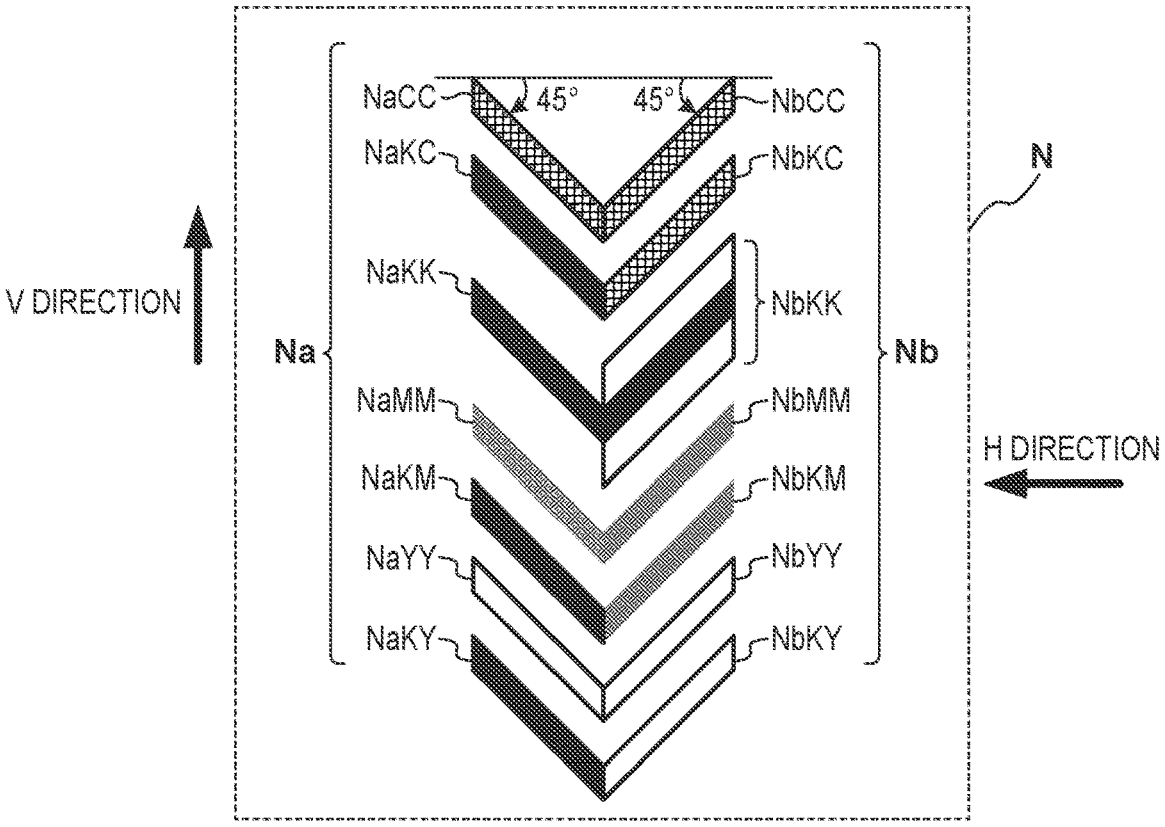

FIGS. 1A and 1B illustrate a color misregistration test image (hereinafter, unless another test image is mentioned, the color misregistration test image will be simply referred to as a test image) for detecting the color misregistration amount according to the present embodiment. Note that hereinafter, the advancement direction of the front surface of the intermediate transfer belt 20 is referred to as the V direction, and the direction from the right to the left of the diagram when the V direction is the upward direction in the diagram is referred to as the H direction. The test image includes one or more basic patterns, a basic pattern including one pattern group P and one pattern group N. FIG. 1A illustrates the pattern group P, and FIG. 1B illustrates the pattern group N. As illustrated in FIGS. 1A and 1B, the pattern group P and the pattern group N have different shapes, but are axisymmetric about an axis corresponding to the main scan direction.

As illustrated in FIG. 1A, the pattern group P includes a plurality of linear patterns in a pattern group Pa and a plurality of linear patterns in a pattern group Pb. Note that, the linear patterns of the pattern group Pa and the linear patterns of the pattern group Pb have a 1-to-1 relationship, and a single V-shaped pattern is formed by the linear patterns of one set corresponding to the pattern group Pa and the pattern group Pb. Also, each V-shaped pattern of the pattern group P points in the V direction. Specifically, the linear patterns of the pattern group Pa are inclined in the direction opposite the V direction as they extend in the H direction, and the linear patterns of the pattern group Pb are inclined in the V direction as they extend in the H direction. Note that the inclination angle of the linear patterns of both the pattern group Pa and the pattern group Pb with respect to the main scan direction may be 45 degrees. The pattern group Pa and the pattern group Pb have an axisymmetric shape about an axis corresponding to the sub-scan direction. Note that as described above, though the V-shaped pattern is a pattern formed by two corresponding linear patterns, a perfect V shape is not necessary. For example, the two linear patterns may not meet at the pointed portion of the V-shaped pattern leaving a small gap or the two linear patterns may overlap forming a region at the pointed portion of the V-shaped pattern.

Note that as illustrated in FIG. 1A and described below, the linear patterns of the pattern group P are divided into patterns listed as pattern "PxAB". Herein, "x" is either "a" or "b", and "A" and "B" are either Y, M, C, or K. When "x" is "a", this indicates that the linear pattern is of the pattern group Pa, and when "x" is "b", this indicates that the linear pattern is of the pattern group Pb. Also, "A" indicates the color of the linear pattern on the pattern group Pa side of one V-shaped pattern, and "B" indicates the color of the linear pattern on the pattern group Pb of one V-shaped pattern. Note that Y, M, C, and K represent yellow, magenta, cyan, and black, respectively. For example, a pattern PaKM is a black linear pattern for pattern group Pa and a magenta linear pattern for the corresponding pattern group Pb. In a similar manner, a pattern PbKY is a yellow linear pattern for pattern group Pb and a black linear pattern for the corresponding pattern group Pa.

Note that the linear patterns of the pattern group Pa are formed across the pattern position a, and the linear patterns of the pattern group Pb are formed across the pattern position b. Thus, as illustrated in FIG. 11A, the light-receiving element 5 of the optical sensor 30 receives the specular reflected light reflected at the position the linear patterns of the pattern group Pa pass, and the light-receiving element 6 of the optical sensor 30 receives the diffuse reflected light reflected at the position the linear patterns of the pattern group Pb pass. Here, because the front surface of the intermediate transfer belt 20 and black (achromatic color) toner cause minimal diffuse reflection, for a pattern PbKK, the pattern is formed on a yellow (chromatic color) toner pattern. The diffuse reflection reflected at a yellow toner is more pronounced compared to when reflected at a black toner. Thus, the microcomputer 301 can detect the pattern PbKK by detecting a decrease in the amount of light received by the light-receiving element 6.

As illustrated in FIG. 1B, the pattern group N, simply put, is the pattern group P with the V-shaped patterns inverted symmetrically about an axis corresponding to the main scan direction. In other words, when the patterns of either the pattern group P or the pattern group N each form a V shape, the patterns of the other pattern group each form an inverted V shape when viewed in the same direction. Note that being an inverted V-shaped pattern does not change the fact that it is a V-shaped pattern. As illustrated in FIG. 1B, the pattern group N includes a plurality of linear patterns in a pattern group Na and a plurality of linear patterns in a pattern group Nb. Note that, the linear patterns of the pattern group Na and the linear patterns of the pattern group Nb have a 1-to-1 relationship, and a single V-shaped pattern is formed by the linear patterns of one set corresponding to the pattern group Na and the pattern group Nb. Also, each V-shaped pattern of the pattern group N points in the direction opposite the V direction. Specifically, the linear patterns of the pattern group Na are inclined in the V direction as they extend in the H direction, and the linear patterns of the pattern group Nb are inclined in the direction opposite the V direction as they extend in the H direction. Note that the pattern group Na and the pattern group Nb both have an inclination angle of 45 degrees with respect to the main scan direction. The pattern group Na and the pattern group Nb have an axisymmetric shape about an axis corresponding to the sub-scan direction. Note that as illustrated in FIG. 1B and described below, the linear patterns of the pattern group N are divided into patterns listed as pattern "NxAB". Note that the naming convention for "x", "A", and "B" is the same as for the pattern group P. Note that as with the pattern PbKK, a pattern NbKK is formed on a yellow toner pattern.

Figure 2A:
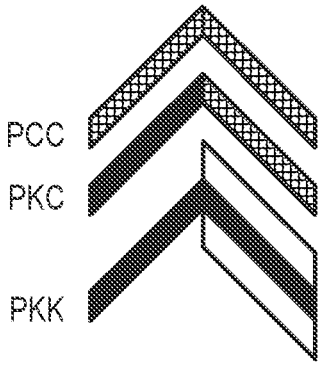
FIGS. 2A to 2C are explanatory diagrams of V-shaped patterns in the basic patterns used to determine the color misregistration amount of each color.
Figure 2B:
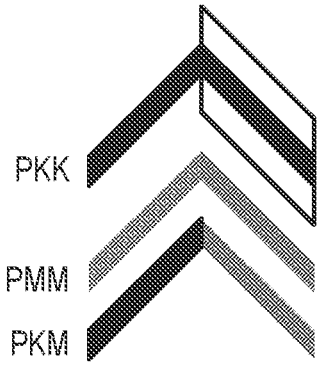
Figure 2C:
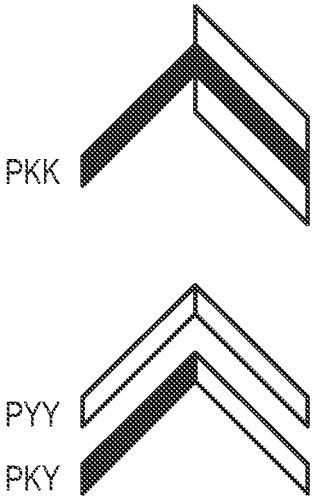
Figure 2C:
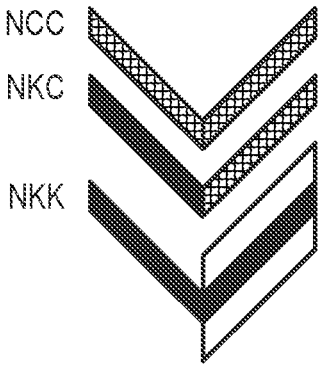
Figure 2C:
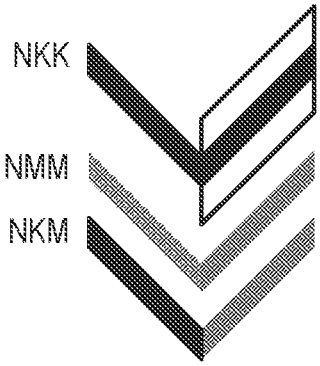
Figure 2C:
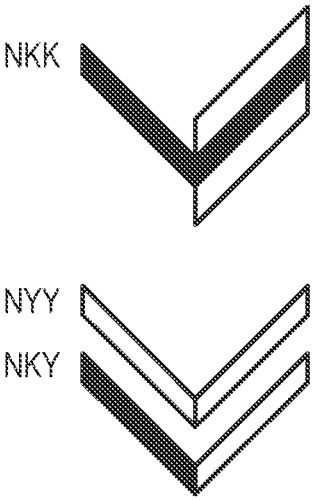

As described above, in the present embodiment, the basic pattern includes one pattern group P and one pattern group N, and color misregistration correction control is executed using a test image including one or more basic patterns. Note that in the present embodiment, the reference color for the color misregistration amount is black. In other words, in the present embodiment, the microcomputer 301 obtains the color misregistration amount for yellow, magenta, and cyan with respect to black. FIG. 2A illustrates a V-shaped pattern used in obtaining the color misregistration amount of cyan in the basic pattern. Also, FIG. 2B illustrates a V-shaped pattern used in obtaining the color misregistration amount of magenta in the basic pattern. Furthermore, FIG. 2C illustrates a V-shaped pattern used in obtaining the color misregistration amount of yellow in the basic pattern. Note that in FIGS. 2A to 2C, the "x" in pattern "PxAB" and pattern "NxAB" is omitted. As illustrated in FIGS. 2A to 2C, the color misregistration amount of a determination target color is determined using a V-shaped pattern formed from only the determination target color, a V-shaped pattern formed from only black, i.e., the reference color, and a V-shaped pattern formed from the determination target color and black.

Figure 3A:
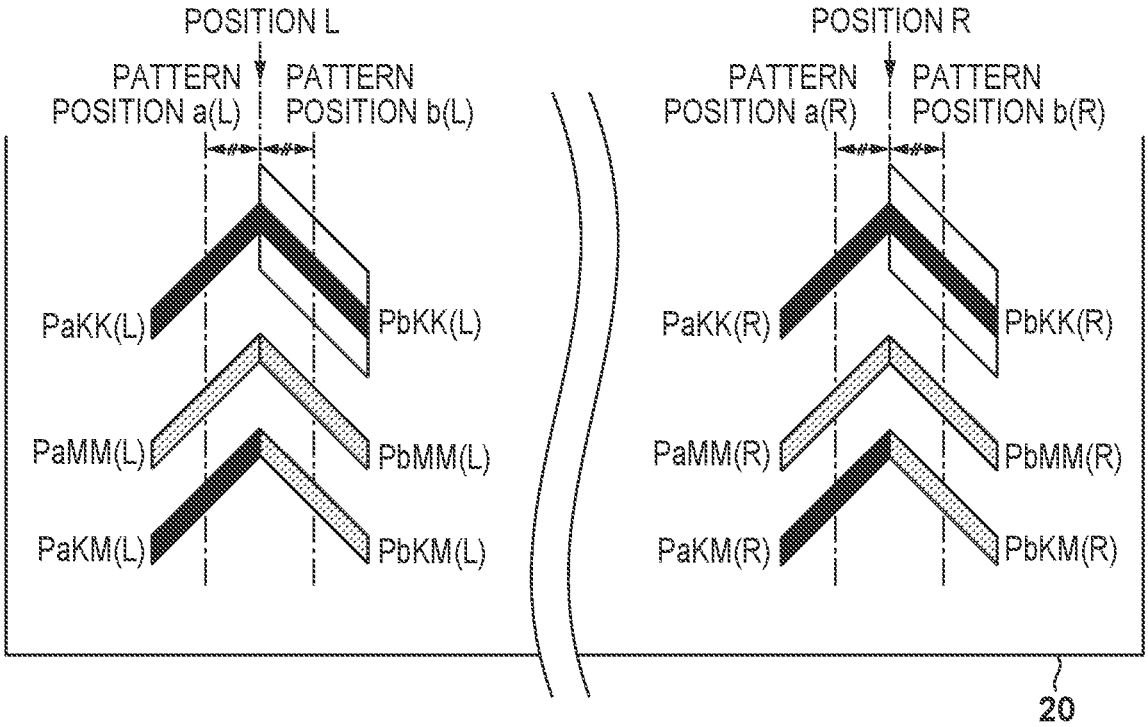
FIGS. 3A and 3B are explanatory diagrams of a method for determining the color misregistration amount according to an embodiment.
Figure 3B:
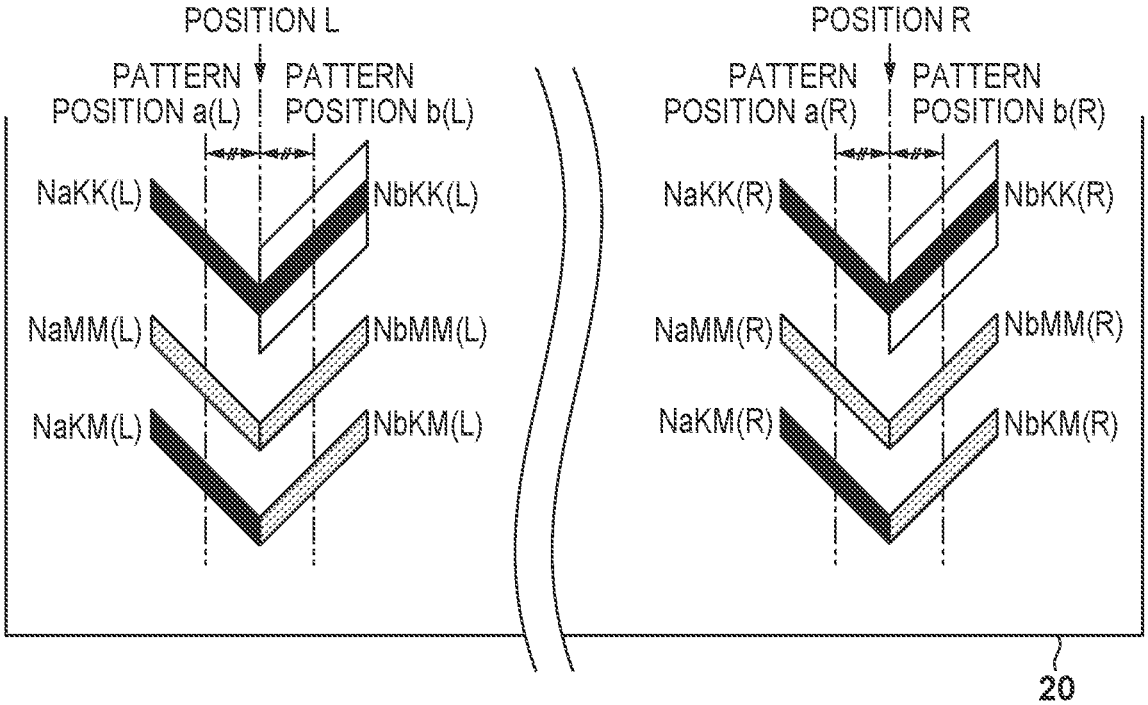

A method for determining the color misregistration amount will be described below. Note that as described above, in the present embodiment, the color misregistration amounts for magenta, cyan, and yellow are determined with respect to black. However, the method for determining the color misregistration amount of each color is the same, and thus the method for determining the color misregistration amount of magenta will be described below. FIGS. 3A and 3B illustrate only a V-shaped pattern used in determining the color misregistration amount of magenta in a single basic pattern. Note that for FIGS. 3A and 3B and diagrams similar to FIGS. 3A and 3B described below, the direction from down to up in the diagram is the V direction and the direction from right to left in the diagram is the H direction. In the present embodiment, a test image is formed in a region at both end portions of the intermediate transfer belt 20 in the main scan direction. Herein, the position where the center of the test image formed on the left side in the diagram is indicated as a position L, and the position where the center of the test image formed on the right side in the diagram is indicated as a position R. Also, the letter "(L)" is added to the pattern position a and the pattern position b and the patterns of the test image at position L, and the letter "(R)" is added to the pattern position a and the pattern position b and the patterns of the test image at position R.

Note that in the present embodiment, as the test images are formed at the position L and the position R, two optical sensors 30 are provided. Hereinafter, the optical sensor that detects the test image at the position L is indicated as an optical sensor 30L, and the optical sensor that detects the test image at the position R is indicated as an optical sensor 30R. Note that FIG. 3A illustrates the pattern group P formed at the position L and the position R, and FIG. 3B illustrates the pattern group N formed at the position L and the position R.

The microcomputer 301 determines the misregistration amount in the V direction of a linear pattern of the pattern group Pb of a single V-shaped pattern with respect to a linear pattern of the pattern group Pa of the same V-shaped pattern on the basis of the detection result of the pattern group P formed at the position L obtained by the optical sensor 30L. Note that in a case where the linear pattern of the pattern group Pb is misregistered in the direction opposite the V direction with respect to the corresponding linear pattern of the pattern group Pa, the misregistration amount is taken as a positive value, and in a case where the misregistration is in the V direction, the misregistration amount is taken as a negative value. The microcomputer 301 obtains three values, dPKK(L), dPMM(L), and dPKM(L) on the basis of the pattern group P formed at the position L. Note that dPKK(L) is the misregistration amount of a pattern PbKK(L) with respect to a pattern PaKK(L). Also, dPMM(L) is the misregistration amount of a pattern PbMM(L) with respect to a pattern PaMM(L). Furthermore, dPKM(L) is the misregistration amount of a pattern PbKM(L) with respect to a pattern PaKM(L).

The microcomputer 301, using the three misregistration amounts, obtains detected misregistration amounts Pa(L) and Pb(L), which are the magenta color misregistration amounts with respect to black at the pattern position a and the pattern position b, respectively, via the following formulas.

$$Pa(L)=d\mathrm{PKM}(L)-d\mathrm{PMM}(L) \quad (1)$$

$$Pb(L)=d\mathrm{PKM}(L)-d\mathrm{PKK}(L) \quad (2)$$

Furthermore, the microcomputer 301, using the detected misregistration amounts Pa(L) and Pb(L), obtains a main scan direction misregistration amount Ps(L) and a sub-scan direction misregistration amount Pp(L) via the following formulas.

$$Ps(L)=(Pa(L)-Pb(L))/2 \quad (3)$$

$$Pp(L)=(Pa(L)+Pb(L))/2 \quad (4)$$

Also, the microcomputer 301, on the basis of the detection result of the pattern group P formed at the position R obtained by the optical sensor 30R, obtains misregistration amounts as those for the pattern group P formed at the position L are obtained via the following formulas.

$$Pa(R)=d\mathrm{PKM}(R)-d\mathrm{PMM}(R) \quad (5)$$

$$Pb(R)=d\mathrm{PKM}(R)-d\mathrm{PKK}(R) \quad (6)$$

$$Ps(R)=(Pa(R)-Pb(R))/2 \quad (7)$$

$$Pp(R)=(Pa(R)+Pb(R))/2 \quad (8)$$

Formulas (5) to (8) correspond to Formulas (1) to (4) and are for the test image formed at the position R. Thus, the "(L)" in Formulas (1) to (4) is replaced with "(R)".

The microcomputer 301, using the misregistration amounts obtained via Formulas (3), (4), (7), and (8), obtains four color misregistration amounts Ps1, Ps2, Pp1, and Pp2 via the following formulas.

$$Ps1=(Ps(L)+Ps(R))/2 \quad (9)$$

$$Ps2=-(Ps(L)-Ps(R)) \quad (10)$$

$$Pp1=(Pp(L)+Pp(R))/2 \quad (11)$$

$$Pp2=(Pp(L)-Pp(R)) \quad (12)$$

Note that Ps1 is the misregistration amount of the starting position in the main scan direction (hereinafter, referred to as the main scan position misregistration amount). Also, Ps2 is the misregistration amount of the length of the image in the main scan direction (hereinafter, referred to as the main scan length misregistration amount). Also, Pp1 is the misregistration amount of the starting position in the sub-scan direction (hereinafter, referred to as the sub-scan position misregistration amount). Furthermore, Pp2 is the inclination amount of the image in the sub-scan direction (hereinafter, referred to as the inclination misregistration amount).

The microcomputer 301, using the detection result of the pattern group N formed at the position L obtained by the optical sensor 30L and the detection result of the pattern group N formed at the position R obtained by the optical sensor 30R, obtains misregistration amounts in a similar manner to how those of the pattern group P are obtained via the following formulas.

$$Na(L)=d\mathrm{NKM}(L)-d\mathrm{NMM}(L) \quad (13)$$

$$Nb(L)=d\mathrm{NKM}(L)-d\mathrm{NKK}(L) \quad (14)$$

$$Ns(L)=-(Na(L)-Nb(L))/2 \quad (15)$$

$$Np(L)=(Na(L)+Nb(L))/2 \quad (16)$$

$$Na(R)=d\mathrm{NKM}(R)-d\mathrm{NMM}(R) \quad (17)$$

$$Nb(R)=d\mathrm{NKM}(R)-d\mathrm{NKK}(R) \quad (18)$$

$$Ns(R)=-(Na(R)-Nb(R))/2 \quad (19)$$

$$Np(R)=(Na(R)+Nb(R))/2 \quad (20)$$

$$Ns1=(Ns(L)+Ns(R))/2 \quad (21)$$

$$Ns2=(Ns(L)-Ns(R)) \quad (22)$$

$$Np1=(Np(L)+Np(R))/2 \quad (23)$$

$$Np2=(Np(L)-Np(R)) \quad (24)$$

Formulas (13) to (24) correspond to Formulas (1) to (12) and use the detection results of the pattern group N. Thus, the "P" in Formulas (1) to (12) is replaced with "N". Note that the plus/minus signs of formulas (15) and (19) are inverted with respect to formulas (3) and (7) to adjust the plus/minus sign of the misregistration amount.

The microcomputer 301, using the values obtained via formulas (9) to (12) and the values obtained via formulas (21) to (24), obtains the color misregistration amounts for magenta via the following formulas.

$$S1=(Ps1+Ns1)/2 \quad (25)$$

$$S2=(Ps2+Ns2)/2 \quad (26)$$

$$P1=(Pp1+Np1)/2 \quad (27)$$

$$P2=(Pp2+Np2)/2 \quad (28)$$

Note that S1 is the main scan position misregistration amount, and S2 is the main scan length misregistration amount. Also, P1 is the sub-scan position misregistration amount, and P2 is the inclination misregistration amount. Formulas (25) to (28) obtain the average value of the color misregistration amounts corresponding to the four color misregistration amounts obtained for the pattern group P and the four color misregistration amounts obtained for the pattern group N.

Figure 4A:
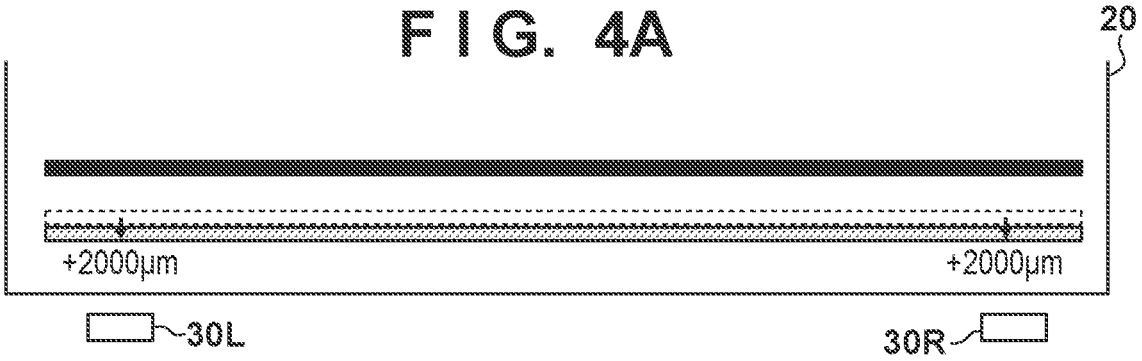
FIGS. 4A to 4C are diagrams illustrating detection examples of the color misregistration amount when sub-scan position misregistration occurs.
Figure 4B:
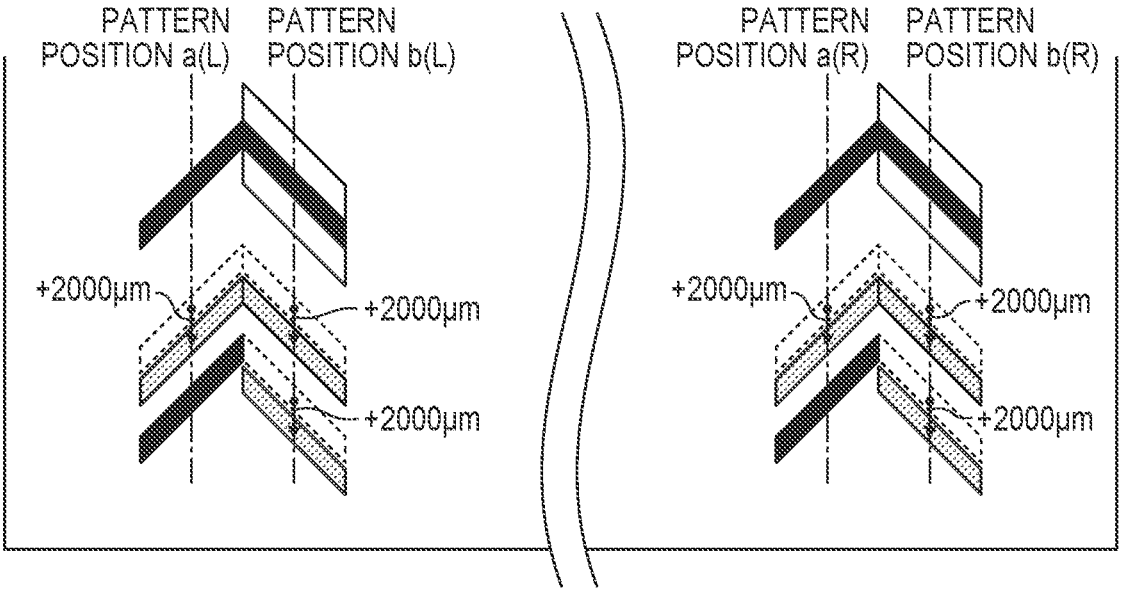
Figure 4C:
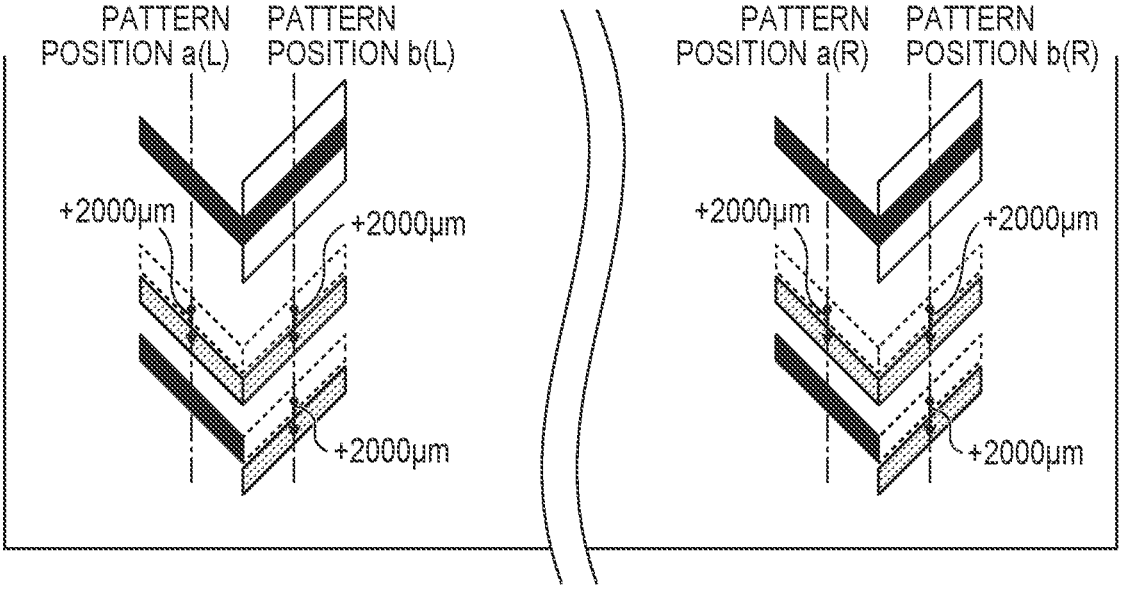

The method for determining the color misregistration amounts described above relating to FIGS. 3A and 3B will be described below using an example with specific values. FIG. 4A illustrates a state in which the starting position in the sub-scan direction of magenta is misregistered by +2000 μm. FIG. 4B illustrates the pattern group P in the same example. FIG. 4C illustrates the pattern group N in the same example. Note that in FIGS. 4A to 4C and similar diagrams used in descriptions below, the broken line indicates the ideal position when there is no color misregistration.

From FIG. 4B, we see that dPKK(L)=0, dPMM(L)=0, and dPKM(L)=2000. Thus, via Formula (1) and Formula (2),
the detected misregistration amount Pa(L)=2000, and
the detected misregistration amount Pb(L)=2000.

Thus, via Formula (3) and Formula (4),
the main scan direction misregistration amount Ps(L)=0, and
the sub-scan direction misregistration amount Pp(L)=2000.

The same holds for the test image formed at the position R, thus
the main scan direction misregistration amount Ps(R)=0, and
the sub-scan direction misregistration amount Pp(R)=2000.

Thus, via Formulas (9) to (12),
the main scan position misregistration amount Ps1=0,
the main scan length misregistration amount Ps2=0,
the sub-scan position misregistration amount Pp1=2000, and
the inclination misregistration amount Pp2=0.

From FIG. 4C, we see that dNKK(L)=0, dNMM(L)=0, and dNKM(L)=2000. Thus, via Formula (13) and Formula (14),
the detected misregistration amount Na(L)=2000, and
the detected misregistration amount Nb(L)=2000.
Thus, via Formula (15) and Formula (16),
the main scan direction misregistration amount Ns(L)=0, and
the sub-scan direction misregistration amount Np(L)=2000.

The same holds for the test image formed at the position R, thus
the main scan direction misregistration amount Ns(R)=0, and
the sub-scan direction misregistration amount Np(R)=2000.

Thus, via Formulas (21) to (24),
the main scan position misregistration amount Ns1=0,
the main scan length misregistration amount Ns2=0,
the sub-scan position misregistration amount Np1=2000, and
the inclination misregistration amount Np21=0.

Thus, via Formulas (25) to (28),
the main scan position misregistration amount S1=0,
the main scan length misregistration amount S2=0,
the sub-scan position misregistration amount P1=2000, and
the inclination misregistration amount P2=0.

Note that in a case where there is only sub-scan position misregistration as illustrated in FIG. 4A, as can be seen from the result described above, the color misregistration amount can be accurately determined only from the pattern group P and only from the pattern group N.

Figure 5A:
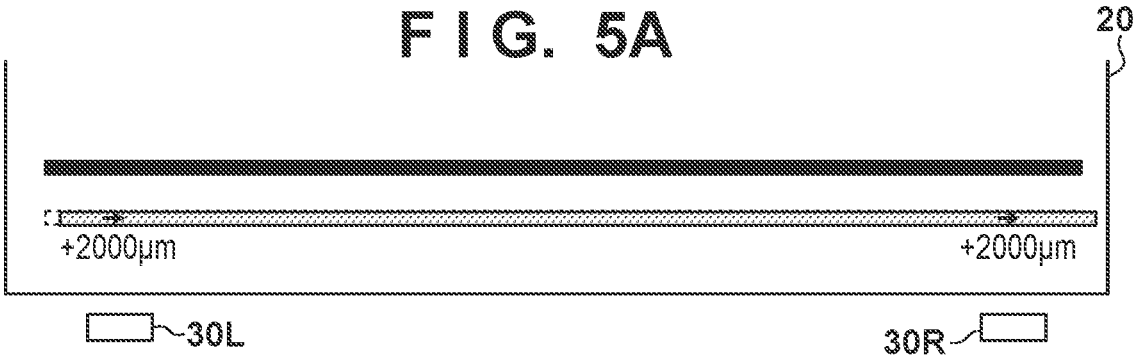
FIGS. 5A to 5C are diagrams illustrating detection examples of the color misregistration amount when main scan position misregistration occurs.
Figure 5B:
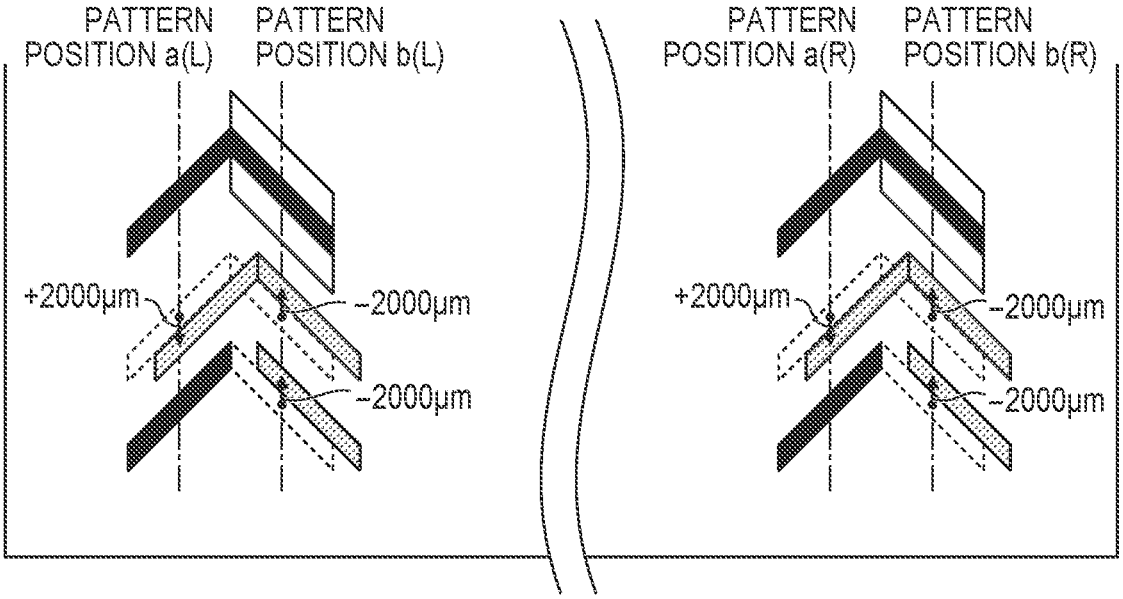
Figure 5C:
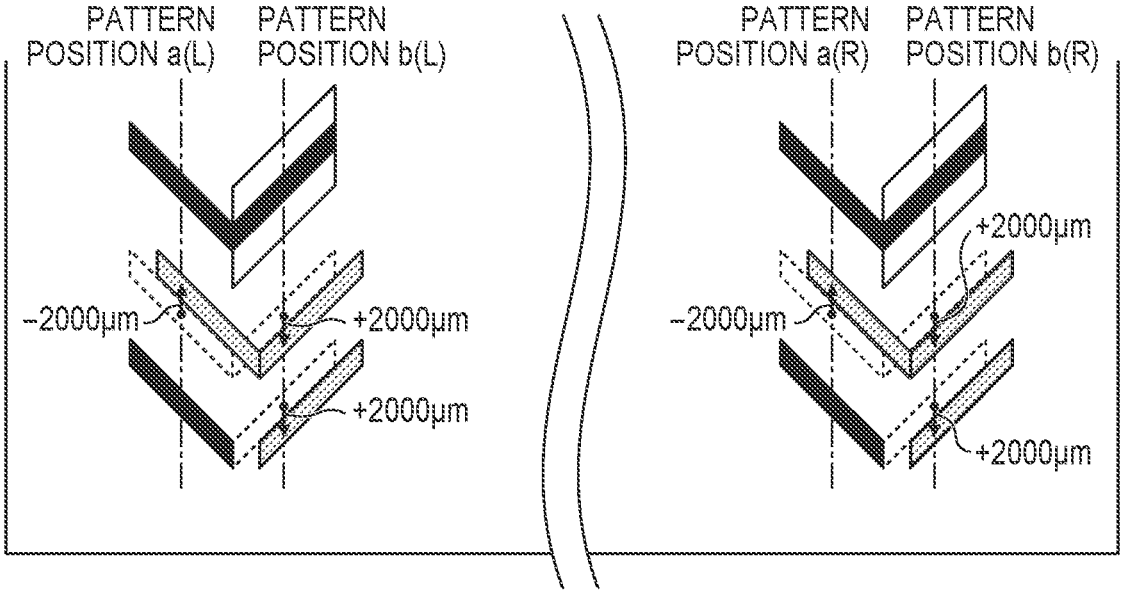

FIG. 5A illustrates a state in which the starting position in the main scan direction of magenta is misregistered by +2000 μm. FIG. 5B illustrates the pattern group P in the same example. FIG. 5C illustrates the pattern group N in the same example.

From FIG. 5B, we see that dPKK(L)=0, dPMM(L)=−4000, and dPKM(L)=−2000. Thus, via Formula (1) and Formula (2),
the detected misregistration amount Pa(L)=2000, and
the detected misregistration amount Pb(L)=−2000.

Thus, via Formula (3) and Formula (4),
the main scan direction misregistration amount Ps(L)=2000, and
the sub-scan direction misregistration amount Pp(L)=0.

The same holds for the test image formed at the position R, thus
the main scan direction misregistration amount Ps(R)=2000, and
the sub-scan direction misregistration amount Pp(R)=0.

Thus, via Formulas (9) to (12),
the main scan position misregistration amount Ps1=2000,
the main scan length misregistration amount Ps2=0,
the sub-scan position misregistration amount Pp1=0, and
the inclination misregistration amount Pp2=0.

From FIG. 5C, we see that dNKK(L)=0, dNMM(L)=4000, and dNKM(L)=2000. Thus, via Formula (13) and Formula (14),
the detected misregistration amount Na(L)=−2000, and
the detected misregistration amount Nb(L)=2000.

Thus, via Formula (15) and Formula (16),
the main scan direction misregistration amount Ns(L)=2000, and
the sub-scan direction misregistration amount Np(L)=0.

The same holds for the test image formed at the position R, thus
the main scan direction misregistration amount Ns(R)=2000, and
the sub-scan direction misregistration amount Np(R)=0.

Thus, via Formulas (21) to (24),
the main scan position misregistration amount Ns1=2000,
the main scan length misregistration amount Ns2=0,
the sub-scan position misregistration amount Np1=0, and
the inclination misregistration amount Np2=0.

Thus, via Formulas (25) to (28),
the main scan position misregistration amount S1=2000,
the main scan length misregistration amount S2=0,
the sub-scan position misregistration amount P1=0, and
the inclination misregistration amount P2=0.

Note that in a case where there is only main scan position misregistration as illustrated in FIG. 5A, as can be seen from the result described above, the color misregistration amount can be accurately determined only from the pattern group P and only from the pattern group N.

Figure 6A:
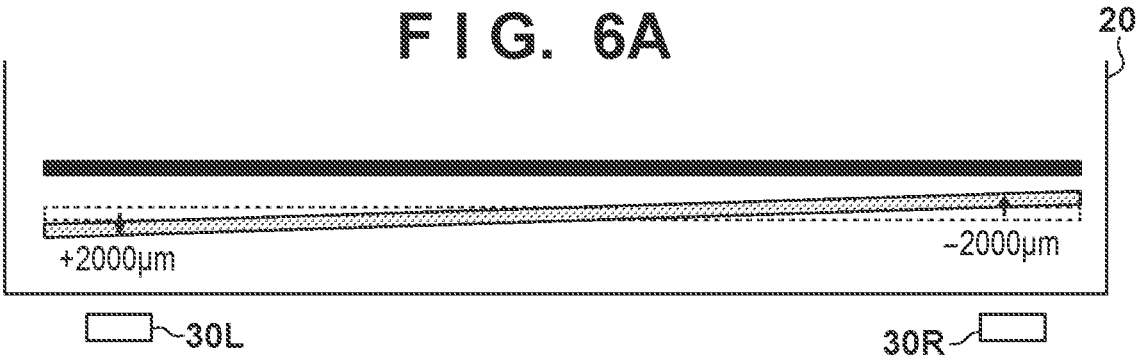
FIGS. 6A to 6C are diagrams illustrating detection examples of the color misregistration amount when an inclination misregistration occurs.
Figure 6B:
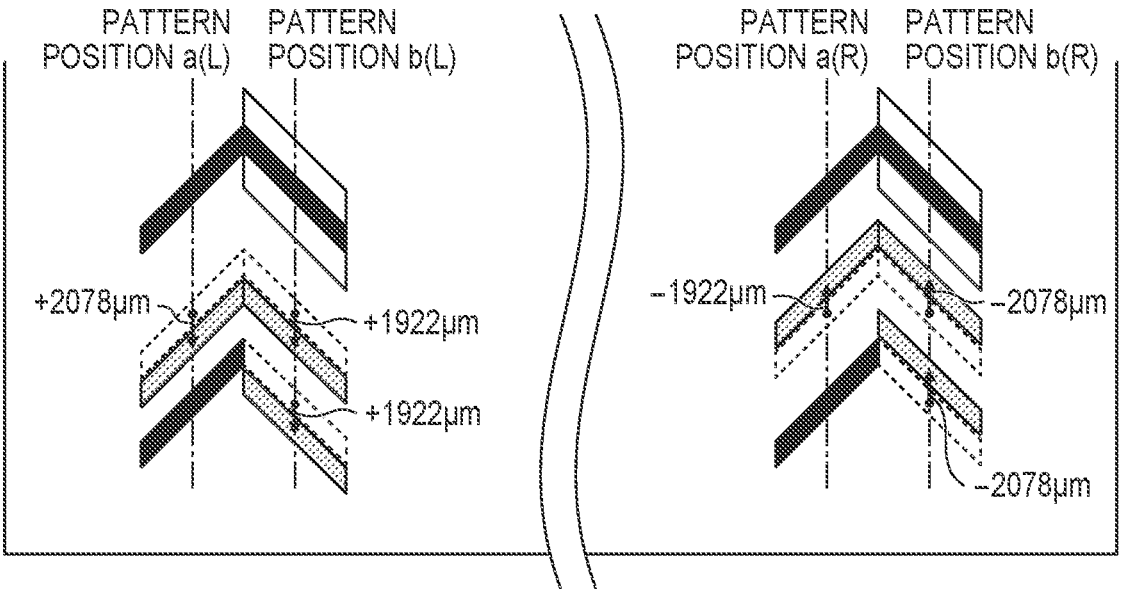
Figure 6C:
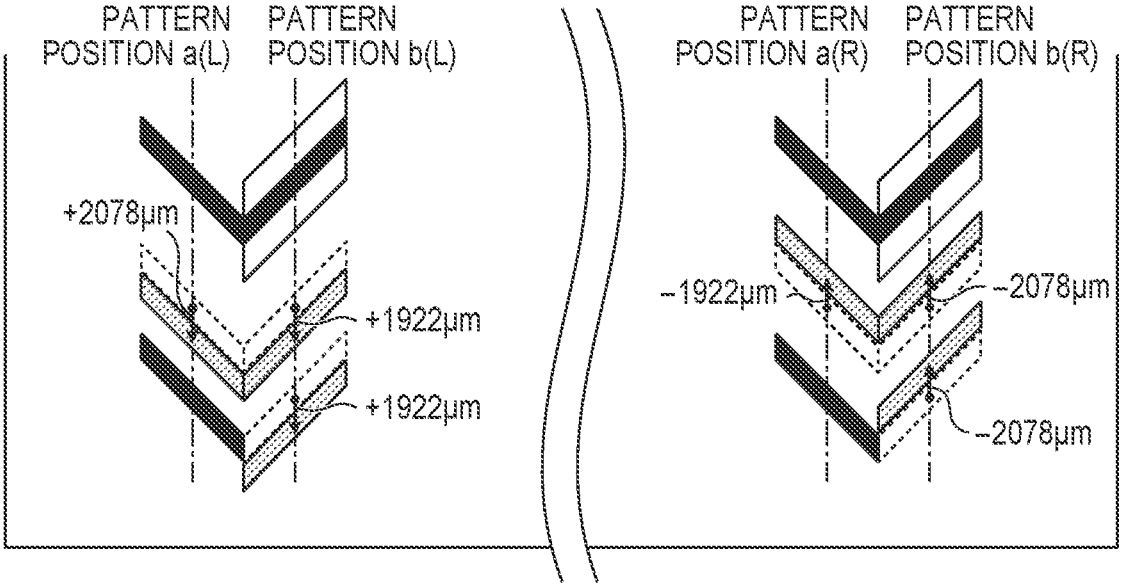

FIG. 6A illustrates a state in which magenta is inclined in the sub-scan direction. As illustrated in FIG. 6A, the position of magenta is misregistered by +2000 μm in the sub-scan direction on the left side of the intermediate transfer belt 20 and is misregistered by −2000 μm in the sub-scan direction on the right side. In other words, there is an overall misregistration of +4000 μm. FIG. 6B illustrates the pattern group P in the same example. FIG. 6C illustrates the pattern group N in the same example. Note that in FIGS. 6B and 6C, the misregistration amount in the sub-scan direction of the position of each linear pattern is also illustrated.

From FIG. 6B, we see that dPKK(L)=0, dPMM(L)=−156, and dPKM(L)=1922. Thus, via Formula (1) and Formula (2), the detected misregistration amount Pa(L)=2078, and the detected misregistration amount Pb(L)=1922.

Thus, via Formula (3) and Formula (4), the main scan direction misregistration amount Ps(L)=78, and the sub-scan direction misregistration amount Pp(L)=2000.

Also, from FIG. 6B, we see that dPKK(R)=0, dPMM(R)=−156, and dPKM(R)=−2078. Thus, via Formula (5) and Formula (6), the detected misregistration amount Pa(R)=−1922, and the detected misregistration amount Pb(R)=−2078.

Thus, via Formula (7) and Formula (8), the main scan direction misregistration amount Ps(R)=78, and the sub-scan direction misregistration amount Pp(R)=−2000.

Thus, via Formulas (9) to (12), the main scan position misregistration amount Ps1=78, the main scan length misregistration amount Ps2=0, the sub-scan position misregistration amount Pp1=0, and the inclination misregistration amount Pp2=4000.

From FIG. 6C, we see that dNKK(L)=0, dNMM(L)=−156, and dNKM(L)=1922. Thus, via Formula (13) and Formula (14), the detected misregistration amount Na(L)=2078, and the detected misregistration amount Nb(L)=1922.

Thus, via Formula (15) and Formula (16), the main scan direction misregistration amount Ns(L)=−78, and the sub-scan direction misregistration amount Np(L)=2000.

Also, from FIG. 6C, we see that dNKK(R)=0, dNMM(R)=−156, and dNKM(R)=−2078. Thus, via Formula (17) and Formula (18), the detected misregistration amount Na(R)=−1922, and the detected misregistration amount Nb(R)=−2078.

Thus, via Formula (19) and Formula (20), the main scan direction misregistration amount Ns(R)=−78, and the sub-scan direction misregistration amount Np(R)=−2000.

Thus, via Formulas (21) to (24), the main scan position misregistration amount Ns1=−78, the main scan length misregistration amount Ns2=0, the sub-scan position misregistration amount Np1=0, and the inclination misregistration amount Np2=4000.

Thus, via Formulas (25) to (28), the main scan position misregistration amount S1=0, the main scan length misregistration amount S2=0, the sub-scan position misregistration amount P1=0, and the inclination misregistration amount P2=4000.

In a case of inclination misregistration such as that illustrated in FIG. 6A, an error occurs in the main scan position misregistration amount for only the pattern group P and only the pattern group N. Specifically, for the pattern group P, Ps1 is determined to be 78 μm and not 0, and for the pattern group N, Ns1 is determined to be −78 μm and not 0. However, in the present embodiment, the final main scan position misregistration amount S1 can be accurately determined as 0 as described above using the detection result of the pattern group P and the detection result of the pattern group N.

Figure 7A:
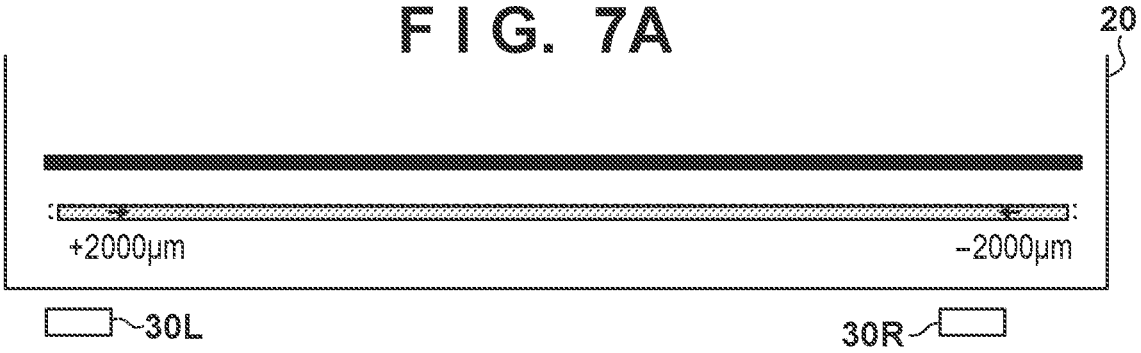
FIGS. 7A to 7C are diagrams illustrating detection examples of the color misregistration amount when main scan length misregistration occurs.
Figure 7B:
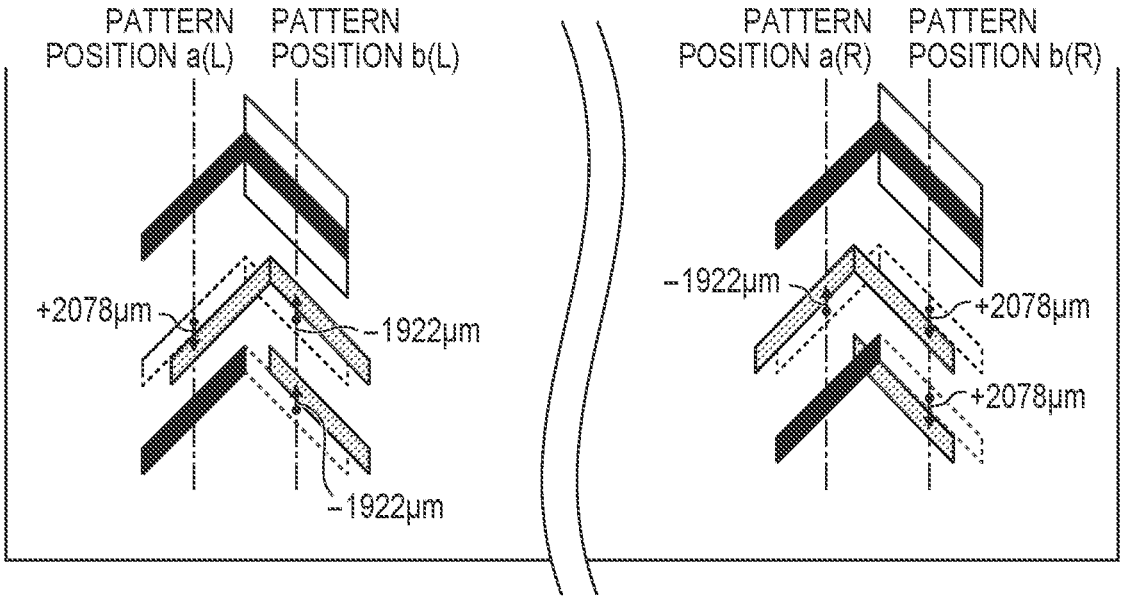
Figure 7C:
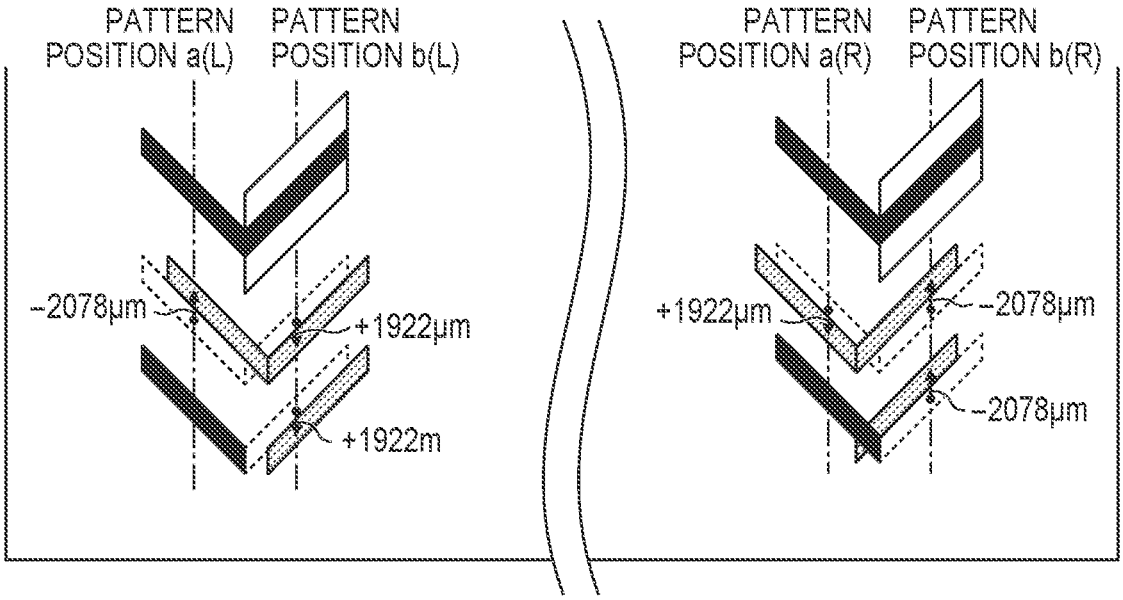

FIG. 7A illustrates a state in which the length (scale) in the main scan direction of magenta is misregistered. As illustrated in FIG. 7A, the position of magenta is misregistered by +2000 μm in the main scan direction on the left side of the intermediate transfer belt 20 and is misregistered by −2000 μm in the main scan direction on the right side. In other words, the length in the main scan direction is 4000 μm shorter. FIG. 7B illustrates the pattern group P in the same example. FIG. 7C illustrates the pattern group N in the same example. Note that in FIGS. 7B and 7C, the misregistration amount in the sub-scan direction of the position of each linear pattern is also illustrated.

From FIG. 7B, we see that dPKK(L)=0, dPMM(L)=−4000, and dPKM(L)=−1922. Thus, via Formula (1) and Formula (2), the detected misregistration amount Pa(L)=2078, and the detected misregistration amount Pb(L)=−1922.

Thus, via Formula (3) and Formula (4), the main scan direction misregistration amount Ps(L)=2000, and the sub-scan direction misregistration amount Pp(L)=78.

Also, from FIG. 7B, we see that dPKK(R)=0, dPMM(R)=4000, and dPKM(R)=2078. Thus, via Formula (5) and Formula (6), the detected misregistration amount Pa(R)=−1922, and the detected misregistration amount Pb(R)=2078.

Thus, via Formula (7) and Formula (8), the main scan direction misregistration amount Ps(R)=−2000, and the sub-scan direction misregistration amount Pp(R)=78.

Thus, via Formulas (9) to (12), the main scan position misregistration amount Ps1=0, the main scan length misregistration amount Ps2=−4000, the sub-scan position misregistration amount Pp1=78, and the inclination misregistration amount Pp2=0.

From FIG. 7C, we see that dNKK(L)=0, dNMM(L)=4000, and dNKM(L)=1922. Thus, via Formula (13) and Formula (14), the detected misregistration amount Na(L)=2078, and the detected misregistration amount Nb(L)=1922.

Thus, via Formula (15) and Formula (16), the main scan direction misregistration amount Ns(L)=2000, and the sub-scan direction misregistration amount Np(L)=−78.

Also, from FIG. 7C, we see that dNKK(R)=0, dNMM(R)=−4000, and dNKM(R)=−2078. Thus, via Formula (17) and Formula (18), the detected misregistration amount Na(R)=1922, and the detected misregistration amount Nb(R)=−2078.

Thus, via Formula (19) and Formula (20), the main scan direction misregistration amount Ns(R)=−2000, and the sub-scan direction misregistration amount Np(R)=−78.

Thus, via Formulas (21) to (24), the main scan position misregistration amount Ns1=0, the main scan length misregistration amount Ns2=−4000, the sub-scan position misregistration amount Np1=−78, and the inclination misregistration amount Np2=0.

Thus, via Formulas (25) to (28), the main scan position misregistration amount S1=0, the main scan length misregistration amount S2=−4000, the sub-scan position misregistration amount P1=0, and the inclination misregistration amount P2=0.

In a case of main scan length misregistration such as that illustrated in FIG. 7A, an error occurs in the sub-scan position misregistration amount for only the pattern group P and only the pattern group N. Specifically, for the pattern group P, Pp1 is determined to be 78 μm and not 0, and for the pattern group N, Np1 is determined to be −78 μm and not 0. However, in the present embodiment, the final sub-scan position misregistration amount P1 can be accurately determined as 0 using the detection result of the pattern group P and the detection result of the pattern group N.

For example, as proposed in Japanese Patent Laid-Open No. 11-164161, an adjustment process of mechanically adjusting the image forming position can be omitted or simplified by instead measuring the color misregistration amount, storing the color misregistration amount in the image forming apparatus, and controlling the forming position of the image on the basis of the stored color misregistration amount. In this case, the labor and time involved in manufacture can be greatly reduced, but the inclination misregistration amount and the main scan length misregistration amount may be increased. With the configuration of U.S. Pat. No. 5,287,162 and the configuration of Japanese Patent Laid-Open No. 2001-134034, the color misregistration amount is determined using a test image including only V-shaped patterns facing the same direction. Thus, as described above, in a case where the image is inclined or a case where the length in the main scan direction is misregistered, an error occurs in the determined color misregistration amount. As the inclination misregistration amount or the main scan length misregistration amount increases, so does this error amount. However, in the present embodiment as described above, the color misregistration amount is determined using the pattern group P and the pattern group N. Thus, even in a case where the image is inclined or a case where the length in the main scan direction is misregistered, the color misregistration amount can be accurately detected.

Also, as described above, to determine the color misregistration amount, the misregistration amount in the sub-scan direction of a linear pattern of a V-shaped pattern has to be determined with respect to the position of another linear pattern of the V-shaped pattern. To accurately determine the misregistration amount in the sub-scan direction, the region 90 and the region 91 of the intermediate transfer belt 20 detected by the optical sensor 30 are set to be left-right symmetrical about the position L and the position R, respectively. Specifically, the region 90 and the region 91 have a shape that is symmetrical in the left-and-right direction of a line in the main scan direction that passes through the position L and the position R, respectively. Also, the light-emitting unit 2 and the light-receiving elements 5 and 6 of the optical sensor 30 and the openings 70, 71, and 75 are formed in a manner to form a symmetrical detection intensity distribution.

Note that in a case where the test image includes a single basic pattern, color misregistration is suppressed by correcting the image forming condition via S1, S2, P1, and P2 obtained via Formulas (25) to (28). However, in a case where the test image includes a plurality of basic patterns, color misregistration is suppressed by correcting the image forming condition via the average values of S1, S2, P1, and P2 obtained for each of the basic patterns.

Note that in the present embodiment, first, the pattern group P is formed on the intermediate transfer belt 20 and then the pattern group N is formed. However, the arrangement of the pattern group P and the pattern group N in the basic pattern may be reversed. Also, the angle of the linear patterns with respect to the main scan direction is 45 degrees. However, it is only required that the linear patterns have different orientations in the main scan direction and the sub-scan direction. Furthermore, in a case where a plurality of basic patterns are formed, the arrangement of the pattern group P and the pattern group N in each of the basic patterns and the order of the V-shaped patterns do not have to be the same for all of the basic patterns.

Second Embodiment

Next, the second embodiment will be described. In the present embodiment, the test image includes a plurality of basic patterns, i.e., two or more basic patterns. The method for disposing the plurality of basic patterns according to the present embodiment will be described below. In the image forming apparatus 700, non-uniformity in the rotation period of the rotating members causes a dynamic difference in the transfer positions. Rotation period non-uniformity is caused by, for example, eccentricity in the driving roller of the intermediate transfer belt 20 or in the photosensitive members 701, eccentricity in the gears for driving these rotating members, variations in the thickness of the intermediate transfer belt 20, and the like. To remove dynamic color misregistration, in the present embodiment, the plurality of basic patterns are formed at positions that cancel out the non-uniformity in the rotation period. Note that by making the arrangement interval of the photosensitive members 701 a multiple of the circumferential length of the driving roller, the dynamic positional difference caused by the driving roller can be cancelled out. In the present embodiment, the pattern position of the reference color and the target color are compared at substantially the same phase in the sub-scan direction and the color misregistration amount is calculated. Thus, the detection error affected by the dynamic positional difference in the driving roller period at the time of detection by the optical sensor 30 is minor. Accordingly, the dynamic color misregistration cancelled out by the arrangement of the plurality of basic patterns may be mainly caused by the rotation period non-uniformity of the photosensitive member 701.

Figure 8:
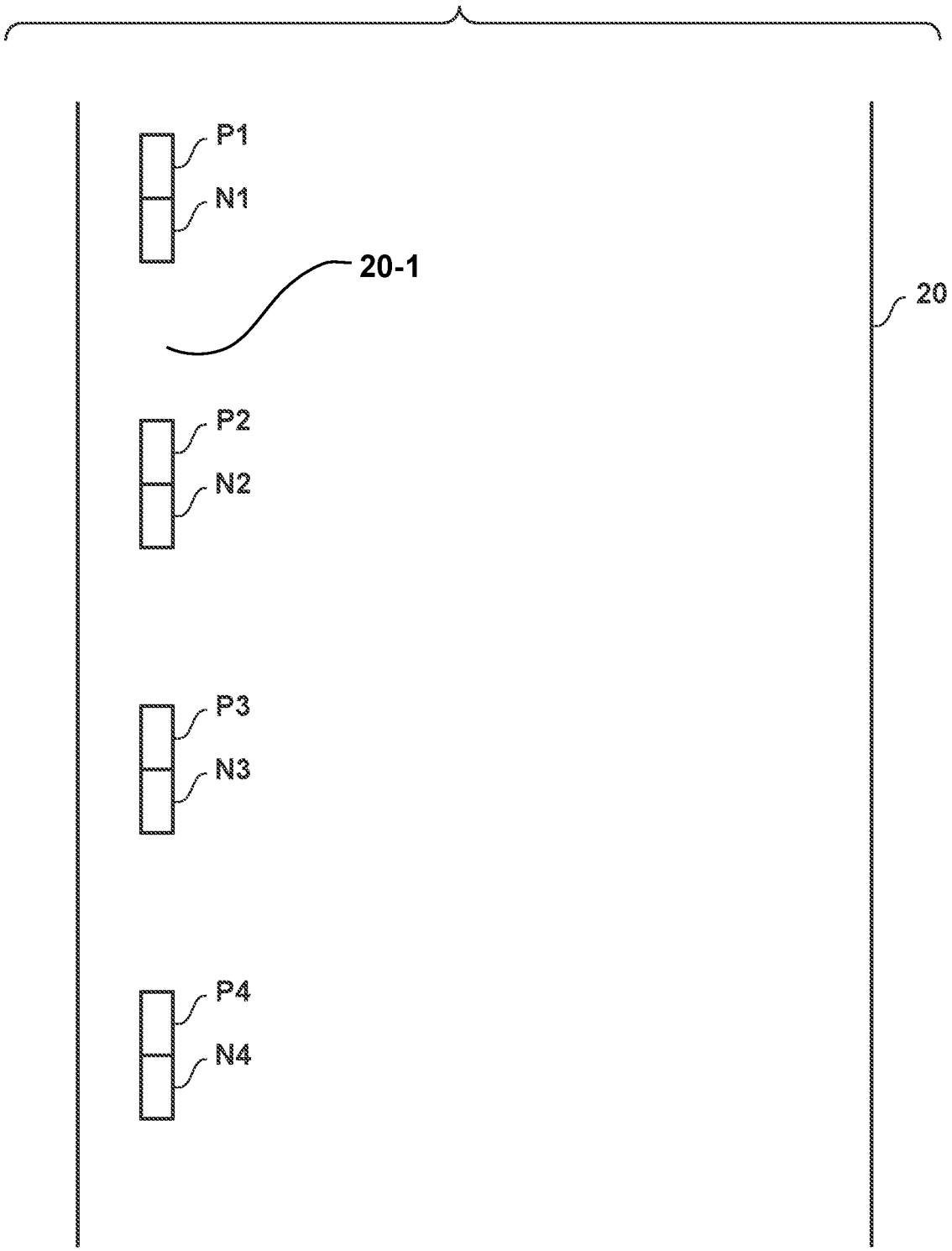
FIG. 8 is a diagram illustrating a test image according to an embodiment.

FIG. 8 illustrates an arrangement example for a test image according to the present embodiment. Note that the method for disposing the test image is the same at the position L and the position R. Thus, for FIG. 8 and similar diagrams of the third embodiment and the fourth embodiment described below, only the arrangement for the test image at the position L is illustrated, and the test image at the position R is omitted. Reference signs P1 to P4 in FIG. 8 indicate the pattern group P, and reference signs N1 to N4 indicate pattern group N. Note that the pattern group Pk (k being an integer from 1 to 4) and the pattern group Nk compose a single basic pattern. As illustrated in FIG. 8, in the present embodiment, the pattern group P and the pattern group N in the basic pattern are disposed continuously in the sub-scan direction. Also, in the present embodiment, four basic patterns are disposed at roughly equal intervals around the intermediate transfer belt 20. Note that the number of basic patterns formed around the intermediate transfer belt 20 may be a discretionary number of 2 or greater. The test image for density correction can be disposed in the blank region where no basic pattern is disposed. This blank region where no basic pattern is disposed can be considered a region for forming an image for detecting density and is identified by reference numeral 20-1 in FIG. 8. By disposing the test image for density correction in the blank region, the density correction control and the color misregistration correction control can be executed in parallel.

In the present embodiment, the pattern group P and the pattern group N in a single basic pattern are disposed adjacent to one another. Accordingly, even in a case where there is variation in the reflection across a long period in the circumferential direction of the intermediate transfer belt 20, the variation in the reflection equally affects the pattern group P and the pattern group N in the single basic pattern.

Thus, color misregistration amount can be accurately determined in state resistant to the effects of a variation in the reflection.

The reason the plurality of basic patterns are disposed at roughly equal intervals around the intermediate transfer belt 20 is to cancel out the rotation period non-uniformity of the intermediate transfer belt 20. Also, the arrangement of the pattern groups P and the pattern groups N of the basic patterns is adjusted to cancel out period non-uniformity of the photosensitive members 701. Specifically, if we define the number of basic patterns as S, S number of the pattern groups P are disposed at positions corresponding to $2\pi\times s/S$ (s being an integer from 1 to S) of the rotational phase of the photosensitive member 701. In a similar manner, S number of the pattern groups N are disposed at positions corresponding to $(\pi+2\pi\times s)/S$ of the rotational phase of the photosensitive member 701. Note that, satisfying a condition that the pattern groups are not allowed to overlap one another, the arrangement of the pattern groups can be determined in a manner so as to minimize the difference between the position of the pattern group P and the pattern group N in a single basic pattern. Also, the arrangement of the pattern groups can be determined in a manner so that the difference between the positions of the pattern groups P and the pattern groups N in the basic patterns are equal.

For example, in FIG. 8, the pattern groups P1, P2, P3, and P4 can be disposed at positions corresponding to 0 degrees, 90 degrees, 180 degrees, and 270 degrees of the rotational phase of the photosensitive member 701. Note that in the present example, when the distance between the pattern group P and the pattern group N is set to 45 degrees for the difference in the rotational phase of the photosensitive member 701, the pattern group P and the pattern group N overlap one another. In this case, the pattern groups N1, N2, N3, and N4 can be disposed at positions corresponding to 135 degrees, 225 degrees, 315 degrees, and 45 degrees of the rotational phase of the photosensitive member 701. In this case, the difference between the position of the pattern group P and the pattern group N in each of the basic patterns is a difference of 135 degrees of the rotational phase of the photosensitive member 701. Also, the pattern groups N1, N2, N3, and N4 can be disposed at positions corresponding to 225 degrees, 315 degrees, 45 degrees, and 135 degrees of the rotational phase of the photosensitive member 701. In this case, the difference between the position of the pattern group P and the pattern group N in each of the basic patterns is a difference of 225 degrees of the rotational phase of the photosensitive member 701.

For example, in a case where three basic patterns are formed, the pattern groups P1, P2, and P3 can be disposed at positions corresponding to 0 degrees, 120 degrees, and 240 degrees of the rotational phase of the photosensitive member 701. Also, the pattern groups N1, N2, and N3 can be disposed at positions corresponding to 180 degrees, 300 degrees, and 60 degrees of the rotational phase of the photosensitive member 701. In this case, the difference between the position of the pattern group P and the pattern group N in each of the basic patterns is a difference of 180 degrees of the rotational phase of the photosensitive member 701. Also, for example, in a case where two basic patterns are formed, the pattern groups P1 and P2 can be disposed at positions corresponding to 0 degrees and 180 degrees of the rotational phase of the photosensitive member 701. Also, the pattern groups N1 and N2 can be disposed at positions corresponding to 90 degrees and 270 degrees of the rotational phase of the photosensitive member 701. In this case, the difference between the position of the pattern group P and the pattern group N in each of the basic patterns is a difference of 90 degrees of the rotational phase of the photosensitive member 701.

As described above, in the present embodiment, the pattern group P and the pattern group N in the basic pattern are disposed continuously in the sub-scan direction. Accordingly, in the circumferential direction of the intermediate transfer belt 20, even when there are variations across a long period in the reflection at the surface, the color misregistration amount can be accurately detected. Also, by disposing the pattern groups P and the pattern groups N of the basic patterns at positions equally dividing the rotational phase of the photosensitive member 701, effects of period non-uniformity can be suppressed and the color misregistration amount can be accurately determined. Also, by disposing the plurality of basic patterns at roughly equal intervals around the intermediate transfer belt, effects of period non-uniformity of the intermediate transfer belt can be suppressed. Furthermore, by providing a region for forming the test image for density correction between adjacent basic patterns, color misregistration correction control and density correction control can be executed in parallel.

Third Embodiment

Figure 9:
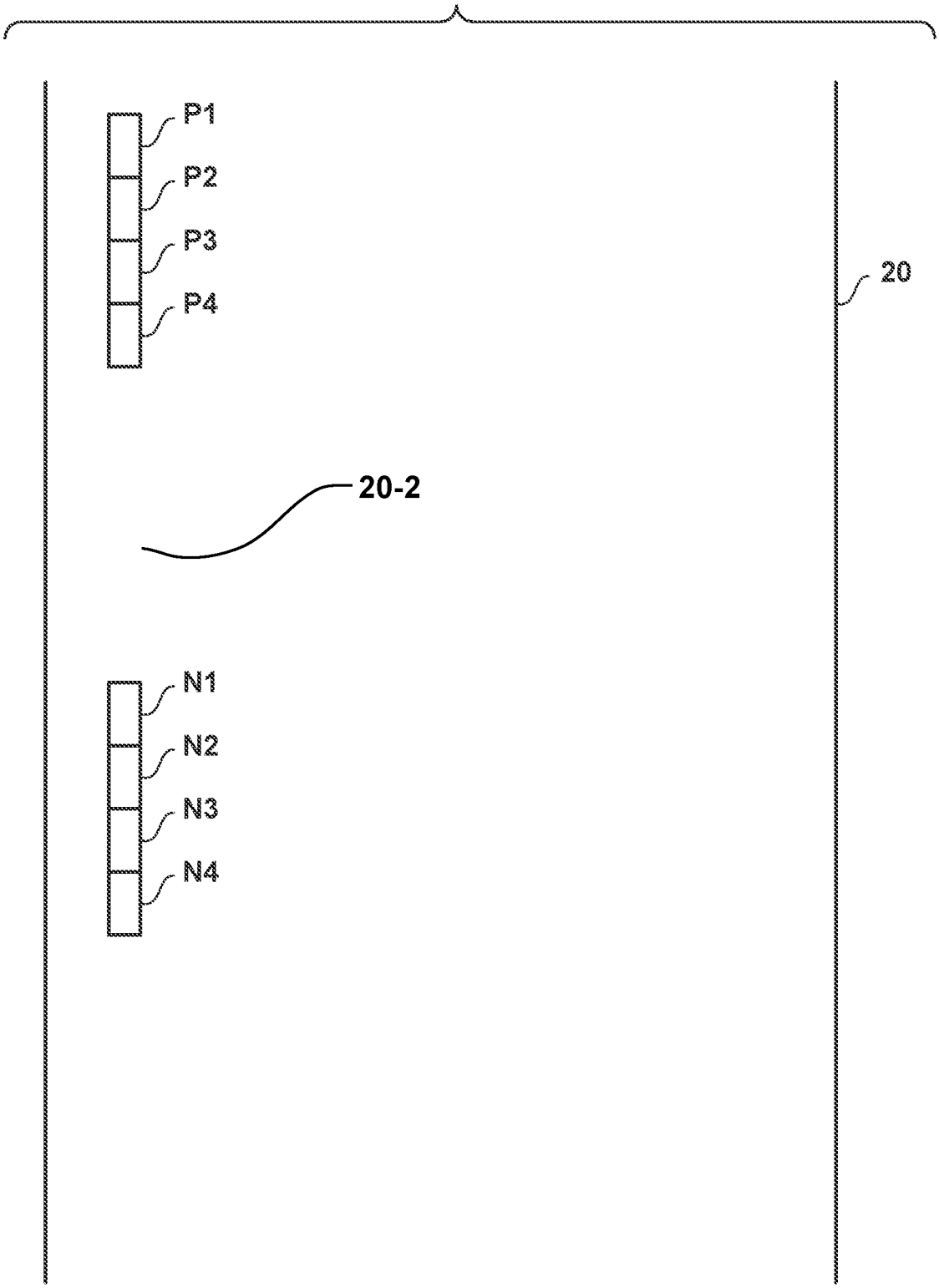
FIG. 9 is a diagram illustrating a test image according to an embodiment.

Next, a third embodiment will be described, focusing on the points that differ from the second embodiment. In the second embodiment, the pattern group P and the pattern group N in a single basic pattern are disposed continuously in the sub-scan direction. In the present embodiment, as illustrated in FIG. 9, the pattern groups P of a plurality (2 or more) basic patterns are disposed continuously in the sub-scan direction, and the pattern groups N are disposed continuously in the sub-scan direction. Also, a region for forming a test image for density correction 20-2 is provided between the plurality of pattern groups P disposed continuously and the plurality of pattern groups N disposed continuously. Note that in FIG. 9, four basic patterns are formed. However, the number of formed basic patterns can be a discretionary number of 2 or greater. By disposing continuously pattern groups P with the same shape and pattern groups N with the same shape, the interval between two identical pattern groups disposed continuously is decreased. This allows for a larger region for forming a test image for density correction to be formed compared to the method for disposing of the second embodiment. Note that also in the present embodiment, the pattern groups P formed continuously and the pattern groups N formed continuously are provided at positions that roughly equally divide the intermediate transfer belt 20. Also, in the present embodiment, the pattern groups are disposed in a manner so that dynamic color misregistration caused by period non-uniformity of the photosensitive member 701 is cancelled out. Note that the pattern group P and the pattern group N are arranged in a manner similar to that of the second embodiment.

For example, the pattern groups P1, P2, P3, and P4 can be disposed at positions corresponding to 0 degrees, 270 degrees, 180 degrees, and 90 degrees of the rotational phase of the photosensitive member 701. Also, the pattern groups N1, N2, N3, and N4 can be disposed at positions corresponding to 45 degrees, 315 degrees, 225 degrees, and 135 degrees of the rotational phase of the photosensitive member 701. In a case where three basic patterns are formed, the pattern groups P1, P2, and P3 can be disposed at positions corresponding to 0 degrees, 120 degrees, and 240 degrees of the rotational phase of the photosensitive member 701. Also, the pattern groups N1, N2, and N3 can be disposed at positions corresponding to 60 degrees, 180 degrees, and 300 degrees of the rotational phase of the photosensitive member 701. Furthermore, in a case where two basic patterns are formed, the pattern groups P1 and P2 can be disposed at positions corresponding to 0 degrees and 180 degrees of the rotational phase of the photosensitive member 701, and the pattern groups N1 and N2 can be disposed at positions corresponding to 90 degrees and 270 degrees of the rotational phase of the photosensitive member 701.

As described above, also in the present embodiment, by disposing the pattern groups P and the pattern groups N of the basic patterns at positions equally dividing the rotational phase of the photosensitive member 701, effects of period non-uniformity can be suppressed and the color misregistration amount can be accurately determined. Also, in the present embodiment, by disposing identical pattern groups continuously, the region for forming the test image for color misregistration detection can be decreased compared to the second embodiment. This allows the region for forming the test image for density correction to be increased.

Fourth Embodiment

Figure 10:
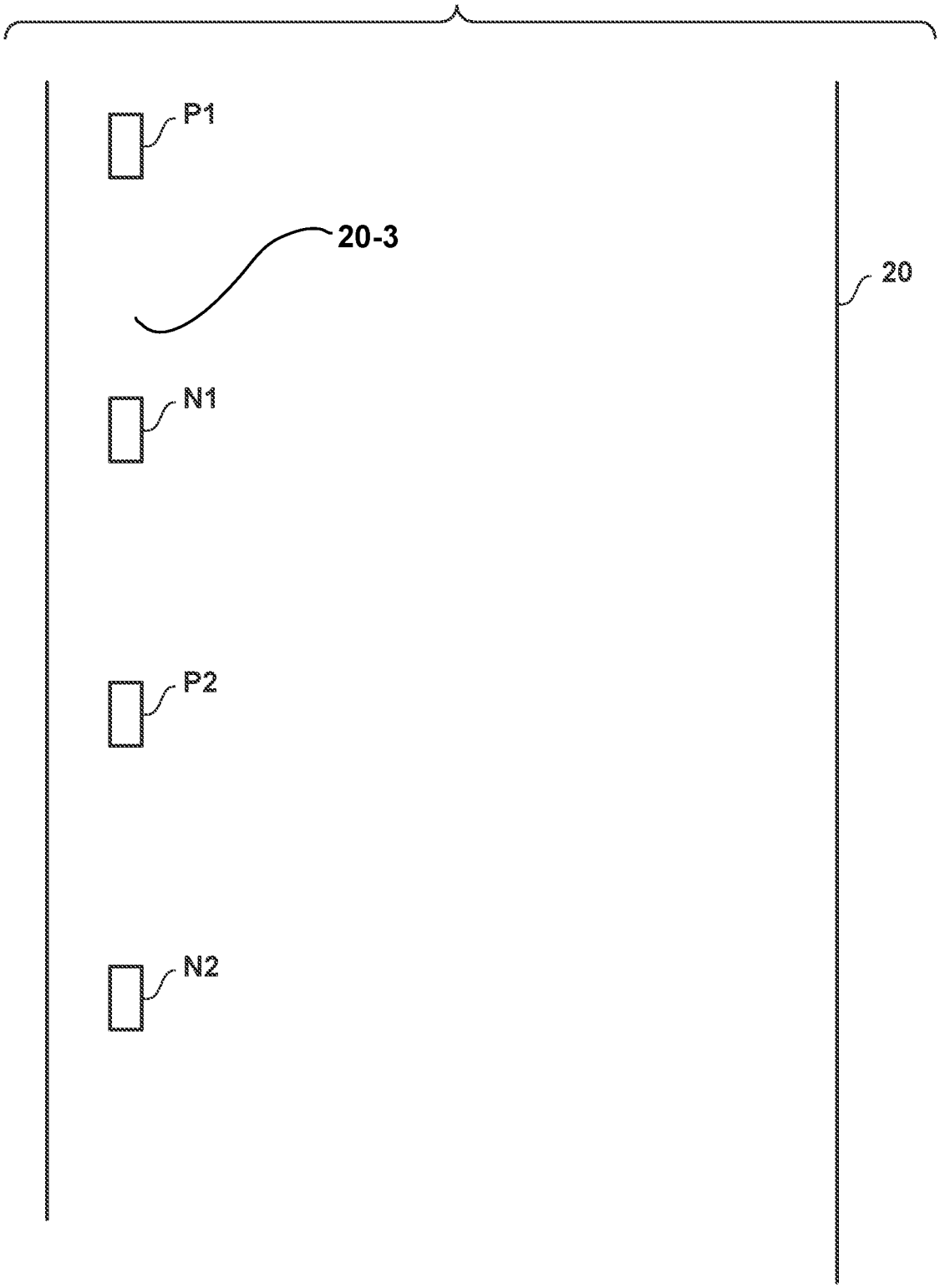
FIG. 10 is a diagram illustrating a test image according to an embodiment.

Next, a fourth embodiment will be described, focusing on the points that differ from the second embodiment. In the present embodiment, as illustrated in FIG. 10, all of the pattern groups of the plurality of basic patterns are disposed separated from one another in the sub-scan direction. For example, when, in the second embodiment, the number of formed basic patterns is two, the period non-uniformity of the intermediate transfer belt 20 is cancelled out by the two basic patterns. In this case, a high-order color misregistration component occurring in a quarter period of the circumferential length of the intermediate transfer belt 20 cannot be cancelled out. Thus, in a case where the effects of variations in the reflection in the circumferential direction of the intermediate transfer belt 20 are not so great, the arrangement illustrated in FIG. 10 can be used to suppress the effects of a high-order color misregistration component occurring in one period of an integral submultiple of the rotation period of the intermediate transfer belt 20. Note that because the period non-uniformity of the photosensitive member 701 is cancelled, the pattern groups P1, P2, N1, and N2 can be disposed at positions corresponding to 0 degrees, 180 degrees, 90 degrees, and 270 degrees of the rotational phase of the photosensitive member 701. Also, the region between the pattern groups can be made a region for forming a test image for density correction 20-3.

As described above, in the present embodiment, a blank region used in density correction control is provided between the pattern groups of each of the basic patterns in the sub-scan direction. By disposing the pattern groups at positions whereby the period non-uniformity of the photosensitive member 701 and the period non-uniformity of the intermediate transfer belt 20 are cancelled, a high-order component of period non-uniformity of the intermediate transfer belt 20 can be cancelled out using less basic patterns than in the first embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-037157, filed Mar. 4, 2020, which is hereby incorporated by reference herein in its entirety.

What is claimed is:

1. An image forming apparatus, comprising:

an image forming unit configured to form an image on a rotationally driven image carrier using toner of a plurality of colors including a first color and a second color;

a detecting unit configured to detect a test image formed on the image carrier by the image forming unit; and an obtaining unit configured to obtain a color misregistration amount using a detection result of the test image from the detecting unit, wherein the test image includes one or more basic patterns;

each one of the one or more basic patterns includes a first pattern group and a second pattern group disposed at different positions with respect to a conveyance direction of the image carrier;

the first pattern group and the second pattern group each includes a plurality of V-shaped patterns;

the plurality of V-shaped patterns included in the first pattern group includes a first V-shaped pattern, and the plurality of V-shaped patterns included in the second pattern group includes a second V-shaped pattern;

the first V-shaped pattern and the second V-shaped pattern are formed in a same color; and the first V-shaped pattern and the second V-shaped pattern have an axisymmetrical shape about an axis corresponding to a width direction orthogonal to the conveyance direction.

2. The image forming apparatus according to claim 1, wherein the image forming unit forms the test image at two or more different positions in the width direction; and 1 wherein the detecting unit includes a plurality of detecting units provided corresponding to test images formed at the two or more different positions.

3. The image forming apparatus according to claim 1, wherein the first pattern group at least includes a V-shaped pattern formed in only the first color, a V-shaped pattern formed in only the second color, and a V-shaped pattern formed in the first color and the second color; and wherein the second pattern group at least includes a V-shaped pattern formed in only the first color, a V-shaped pattern formed in only the second color, and a V-shaped pattern formed in the first color and the second color.

4. The image forming apparatus according to claim 3, wherein each one of the plurality of V-shaped patterns includes a first linear pattern in a direction off from the width direction and the conveyance direction and a second linear pattern that is axisymmetrical to the first linear pattern about an axis corresponding to the conveyance direction; and wherein the first linear pattern of the V-shaped patterns formed in the first color and the second color is formed of the first color, and the second linear pattern of the V-shaped patterns formed in the first color and the second color is formed of the second color.

5. The image forming apparatus according to claim 4, wherein the detecting unit includes:

a light-emitting unit configured to emit light toward the image carrier, a first light-receiving unit configured to mainly receive specular reflected light of light emitted by the light-emitting unit and reflected at the image carrier, and a second light-receiving unit configured to mainly receive diffuse reflected light of light emitted by the light-emitting unit and reflected at the image carrier; and wherein the image forming unit forms the first linear pattern at a reflection position on the image carrier of the specular reflected light received by the first light-receiving unit and forms the second linear pattern at a reflection position on the image carrier of the diffuse reflected light received by the second light-receiving unit.

6. The image forming apparatus according to claim 5, wherein the image forming unit forms the second linear pattern in an achromatic color on a pattern with a chromatic color.

7. The image forming apparatus according to claim 1, wherein the test image includes a plurality of basic patterns; and wherein the first pattern group and the second pattern group in each basic pattern of the plurality of basic patterns is disposed continuously in the conveyance direction.

8. The image forming apparatus according to claim 7, wherein a region for forming an image for detecting density is provided between two basic patterns adjacent in the conveyance direction of the plurality of basic patterns.

9. The image forming apparatus according to claim 7, wherein an arrangement of the plurality of basic patterns is determined on the basis of period non-uniformity of rotation of the image carrier.

10. The image forming apparatus according to claim 7, further comprising a transfer member configured to transfer an image of the first color and an image of the second color on the image carrier; and wherein the test image includes S basic patterns (S being an integer of 2 or greater);

wherein S of the first pattern groups in the S of basic patterns are disposed at positions corresponding to $2\pi\times s/S$ of a rotational phase of the transfer member (s being an integer from 1 to S); and wherein S of the second pattern groups in the S of basic patterns are disposed at positions corresponding to $(\pi+2\pi\times s)/S$ of the rotational phase of the transfer member.

11. The image forming apparatus according to claim 1, wherein the test image includes a plurality of basic patterns; and wherein the first pattern group in each basic pattern of the plurality of basic patterns is disposed continuously in the conveyance direction, and the second pattern group in each basic pattern of the plurality of basic patterns is disposed continuously in the conveyance direction.

12. The image forming apparatus according to claim 11, wherein a region for forming an image for detecting density is provided between the first pattern groups continuously formed and the second pattern groups continuously formed.

13. The image forming apparatus according to claim 11, wherein an arrangement of the first pattern groups continuously formed and the second pattern groups continuously formed is determined on the basis of period non-uniformity of rotation of the image carrier.

14. The image forming apparatus according to claim 1, wherein the test image includes a plurality of basic patterns; and wherein a region for forming an image for detecting density is provided between two basic patterns adjacent in the conveyance direction of the plurality of basic patterns and between the first pattern group and the second pattern group in each one of the basic patterns.

15. The image forming apparatus according to claim 1, wherein each of the plurality of V-shaped patterns included in the first pattern group has a convex shape toward a downstream side in the conveyance direction, and wherein each of the plurality of V-shaped patterns included in the second pattern group has a convex shape toward an upstream side with respect to the conveyance direction.

16. An image forming apparatus, comprising:

an image forming unit configured to form a first test pattern and a second test pattern on an image carrier;

a detecting unit configured to detect the first test pattern and the second test pattern; and an obtaining unit configured to obtain a color misregistration amount using detection results of the first test pattern and the second test pattern by the detecting unit, wherein the first test pattern and the second test pattern are disposed at different positions with respect to a conveyance direction of the image carrier, each of the first test pattern and the second test pattern includes a plurality of V-shaped patterns, the plurality of V-shaped patterns included in the first test pattern includes a first V-shaped pattern, and the plurality of V-shaped patterns included in the second test pattern includes a second V-shaped pattern, the first V-shaped pattern and the second V-shaped pattern are formed in a same color; and the first V-shaped pattern and the second V-shaped pattern have an axisymmetrical shape about an axis corresponding to a width direction orthogonal to the conveyance direction.

17. The image forming apparatus according to claim 16, wherein the image forming unit is further configured to form the first test pattern at two or more different positions in the width direction, and to form the second test pattern at the two or more different positions in the width direction, and wherein the detecting unit includes a plurality of detecting units provided at positions corresponding to the two or more different positions in the width direction.

18. The image forming apparatus according to claim 16, wherein the first test pattern includes a V-shaped pattern formed in only a first color, a V-shaped pattern formed in only a second color, and a V-shaped pattern formed in the first color and the second color, and wherein the second test pattern includes a V-shaped pattern formed in only the first color, a V-shaped pattern formed in only the second color, and a V-shaped pattern formed in the first color and the second color.

19. The image forming apparatus according to claim 18, wherein each one of the plurality of V-shaped patterns included in the first test pattern and the second test pattern includes a first linear pattern in a direction off from the width direction and the conveyance direction and a second linear pattern that is axisymmetrical to the first linear pattern about an axis corresponding to the conveyance direction, and wherein the first linear pattern of the V-shaped patterns formed in the first color and the second color is formed of the first color, and the second linear pattern of the V-shaped patterns formed in the first color and the second color is formed of the second color.

20. The image forming apparatus according to claim 19, wherein the detecting unit includes:

a light-emitting unit configured to emit light toward the image carrier, a first light-receiving unit configured to mainly receive specular reflected light of light emitted by the light-emitting unit and reflected at the image carrier, and a second light-receiving unit configured to mainly receive diffuse reflected light of light emitted by the light-emitting unit and reflected at the image carrier, and wherein the image forming unit is further configured to form the first linear pattern at a reflection position on the image carrier of the specular reflected light received by the first light-receiving unit, and to form the second linear pattern at a reflection position on the image carrier of the diffuse reflected light received by the second light-receiving unit.

21. The image forming apparatus according to claim 16, wherein each of the plurality of V-shaped patterns included in the first test pattern has a convex shape toward a downstream side in the conveyance direction, and wherein each of the plurality of V-shaped patterns included in the second test pattern has a convex shape toward an upstream side with respect to the conveyance direction.

* * * * *